US008608992B2

(12) United States Patent
Chasiotis et al.

(10) Patent No.: US 8,608,992 B2
(45) Date of Patent: Dec. 17, 2013

(54) CARBON NANOFIBERS DERIVED FROM POLYMER NANOFIBERS AND METHOD OF PRODUCING THE NANOFIBERS

(75) Inventors: Ioannis Chasiotis, Savoy, IL (US); Mohammad Naraghi, Evanston, IL (US); Salman N. Arshad, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 76 days.

(21) Appl. No.: 13/243,302

(22) Filed: Sep. 23, 2011

(65) Prior Publication Data

US 2012/0077032 A1 Mar. 29, 2012

Related U.S. Application Data

(60) Provisional application No. 61/386,209, filed on Sep. 24, 2010.

(51) Int. Cl.

| | |
|---|---|
| ***D01D 5/12*** | (2006.01) |
| ***D01F 9/20*** | (2006.01) |
| ***D06M 10/00*** | (2006.01) |
| ***H05B 7/00*** | (2006.01) |

(52) U.S. Cl.
USPC ..... 264/29.2; 264/29.7; 264/210.8; 264/465

(58) Field of Classification Search
USPC ..... 264/29.2, 29.7, 210.8, 464, 465, 466, 264/484
See application file for complete search history.

(56) References Cited

U.S. PATENT DOCUMENTS

| | | | | |
|---|---|---|---|---|
| 7,479,516 | B2 | 1/2009 | Chen et al. | 524/495 |
| 2005/0224999 | A1 * | 10/2005 | Andrady et al. | 264/29.2 X |
| 2005/0287239 | A1 * | 12/2005 | Joo et al. | 425/382.3 |
| 2008/0255492 | A1 * | 10/2008 | Truelsen et al. | 602/43 |
| 2010/0167177 | A1 * | 7/2010 | Yang et al. | 264/465 X |

FOREIGN PATENT DOCUMENTS

WO WO-2008123908 A1 * 10/2008

OTHER PUBLICATIONS

Bahl, O.P. et al., (1998). Manufacture of Carbon Fibers. in J.B. Donnet., T.K. Wang., & J.C.M. Peng, Carbon Fibers pp. 1-83. Marcel Dekker, Inc.
Chae, Han Gi et al., "*Carbon Nanotube Reinforced Small Diameter Polyacrylonitrile Based Carbon Fiber*," Composites Science and Technology, 69 (2009) pp. 406-413.
Chand, S., "*Review: Carbon Fibers for Composites*," Journal of Materials Science 35 (2000) pp. 1303-1313.

(Continued)

*Primary Examiner* — Leo B Tentoni
(74) *Attorney, Agent, or Firm* — Brinks Gilson & Lione

(57) ABSTRACT

A method for producing one or more nanofibers includes providing (a) a solution comprising a polymer and a solvent, (b) a nozzle for ejecting the solution, and (c) a stationary collector disposed a distance d apart from the nozzle. A voltage is applied between the nozzle and the stationary collector, and a jet of the solution is ejected from the nozzle toward the stationary collector. An electric field intensity of between about 0.5 and about 2.0 kV/cm is maintained, where the electric field intensity is defined as a ratio of the voltage to the distance d. At least a portion of the solvent from the stream is evaporated, and one or more polymer nanofibers are deposited on the stationary collector as the stream impinges thereupon. Each polymer nanofiber has an average diameter of about 500 nm or less and may serve as a precursor for carbon fiber production.

9 Claims, 19 Drawing Sheets

(56) References Cited

OTHER PUBLICATIONS

Chen, B.F. et al., "*In Situ Observation of the Cracking Behavior of TiN Coating on 304 Stainless Steel Subjected to Tensile Strain*," Thin Solid Films, 352 (1999) pp. 173-178.
Chronakis, Ioannis S., "*Novel Nanocomposites and Nanoceramics Based on Polymer Nanofibers Using Electrospinning Process—A Review*," Journal of Materials Processing Technology, 167 (2005) pp. 283-293.
Chun, Iksoo et al., "*Carbon Nanofibers from Polyacrylonitrile and Mesophase Pitch*," Journal of Advanced Materials, 31, 1 (1999) pp. 36-41.
Dalton, Stephen et al., "*Thermal Stabilization of Polyacrylonitrile Fibres*," Polymer, 40 (1999) pp. 5531-5543.
Dayal, Pratyush et al., "*Porous Fiber Formation in Polymer-Solvent System Undergoing Solvent Evaporation*," Journal of Applied Physics, 100 (2006) pp. 043512-1-043512-6.
Edie D.D., "*The Effect of Processing on the Structure and Properties of Carbon Fibers*," Carbon, 36, 4 (1998) pp. 345-362.
Guenthner, Andrew J. et al., "*Dynamics of Hollow Nanofiber Formation During Solidification Subjected to Solvent Evaporation*," Macromolecular Theory and Simulations, 15 (2006) pp. 87-93.
Hammel, E. et al., "*Carbon Nanofibers for Composite Applications*," Carbon, 42 (2004) pp. 1153-1158.
Hsiao, K. T. (2007) Processing and Mechanical Properties Characterization of Hybrid Thermoset Polymer Composites with Micro-Fiber and Carbon Nano-Fiber Reinforcements. In S.G. Advani, Processing and Properties of Nanocomposites, pp. 141-189. World Scientific.
Huang, Zheng-Ming et al., "*A Review on Polymer Nanofibers by Electrospinning and their Applications in Nanocomposites*," Composites Science and Technology, 63 (2003) pp. 2223-2253.
Krzhizhek, F., "*Evaporation of a Liquid from a Surface in an Air Jet at Various Schmidt Numbers*", Journal of Engineering Physics and Thermophysics, 34, 3 pp. 286-291. Translated from Inzhenerno-Fizicheskii Zhurnal, 34, 3 (1978) pp. 431-438.
Li, Dan et al., "*Electrospinning of Nanofibers: Reinventing the Wheel?*" Adv. Mater., 16, 14 (2004) pp. 1151-1170.
Liu, J. et al., "*Continuous Carbonization of Polyacrylonitrile-Based Oxidized Fibers: Aspects on Mechanical Properties and Morphological Structure*," Journal of Applied Polymer Science, 52 (1994) pp. 945-950.
Liu, Jie, et al., "*Continuous Nanoscale Carbon Fibers with Superior Mechanical Strength*," Small, 5, 5 (2009) pp. 536-542.
Liu, Fujie, et al., "*Effect of Microstructure on the Mechanical Properties of PAN-Based Carbon Fibers During High-Temperature Graphitization*," J. Mater Sci, 43 (2008) pp. 4316-4322.
Naraghi, Mohammad et al., "*Mechanical Deformation and Failure of Electrospun Polyacrylonitrile Nanofibers as a Function of Strain Rate*," Applied Physics Letters, 91 (2007) pp. 151901-1-151901-3.
Naraghi, Mohammad et al., "*Novel Method for Mechanical Characterization of Polymeric Nanofibers*," Review of Scientific Instruments, 78 (2007) pp. 085108-1-085108-7.
Naraghi, Mohammad et al., "*Optimization of Comb-Driven Devices for Mechanical Testing of Polymeric Nanofibers Subjected to Large Deformations*," Journal of Microelectromechanical Systems, 18, 5 (2009) pp. 1032-1046.
Ozkan, Tanil et al., "*Mechanical Properties of Vapor Grown Carbon Nanofibers*," Carbon, 48 (2010) pp. 239-244.
Rahaman, M.S.A. et al., "*A Review of Heat Treatment on Polyacrylonitrile Fiber*," Polymer Degradation and Stability, 92 (2007) pp. 1421-1432.
Reneker, Darrell H. et al., "*Bending Instability of Electrically Charged Liquid Jets of Polymer Solutions in Electrospinning*," Journal of Applied Physics, 87, 9 (2000) pp. 4531-4547.
Reneker, Darrell H. et al., "*Electrospinning Jets and Polymer Nanofibers*," Polymer, 49 (2008) pp. 2387-2425.
Taylor, F.R.S., Sir Geoffrey, "*Electrically Driven Jets*," Proc. Roy. Soc. Lond. A. 313 (1969) pp. 453-475.
Wang, Tong et al., "*Electrospinning of Polyacrylonitrile Nanofibers*," Journal of Applied Polymer Science, 102 (2006) pp. 1023-1029.
Wangxi, Zhang et al., "*Evolution of Structure and Properties of PAN Precursors During their Conversion to Carbon Fibers*," Carbon, 41 (2003) pp. 2805-2812.
Wu, Xiang-Fa et al., "*Rippling of Polymer Nanofibers*," Physical Review, E 78 (2008) pp. 061804-1-061804-8.
Zhou, Zhengping et al., "*Development of Carbon Nanofibers from Aligned Electrospun Polyacrylonitrile Nanofiber Bundles and Characterization of their Microstructural, Electrical, and Mechanical Properties*," Polymer, 50 (2009) pp. 2999-3006.
Zou, Guifu et al., "*Carbon Nanofibers: Synthesis, Characterization, and Electrochemical Properties*," Carbon, 44 (2006) pp. 828-832.
Zussman, E. et al., "*Mechanical and Structural Characterization of Electrospun PAN-Derived Carbon Nanofibers*," Carbon, 43 (2005) pp. 2175-2185.

* cited by examiner

FIG. 19(a)
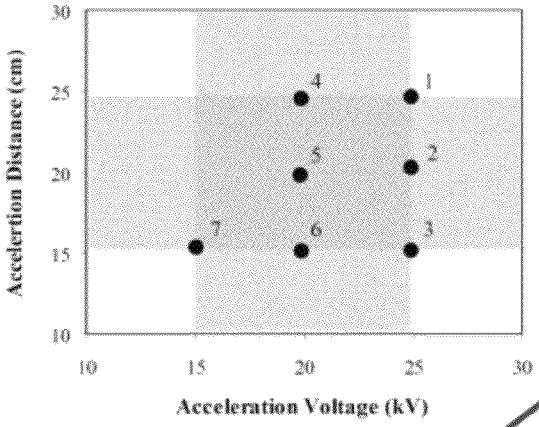
FIG. 19(b)
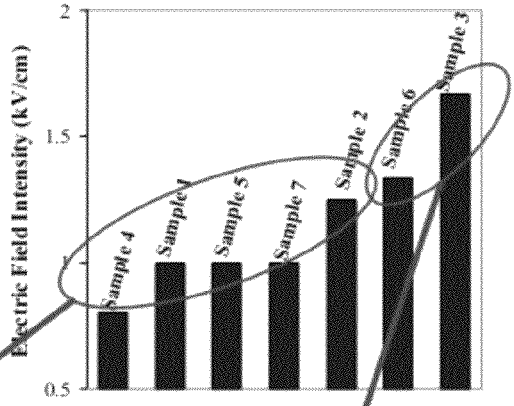
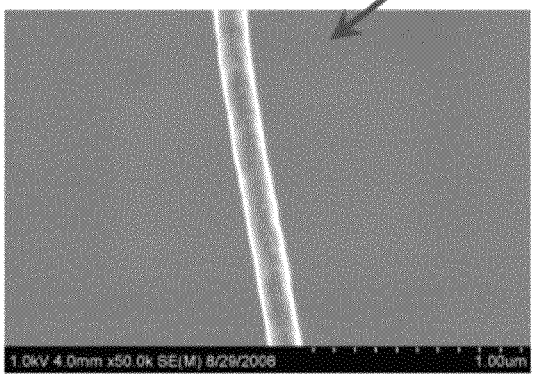
FIG. 19(c)
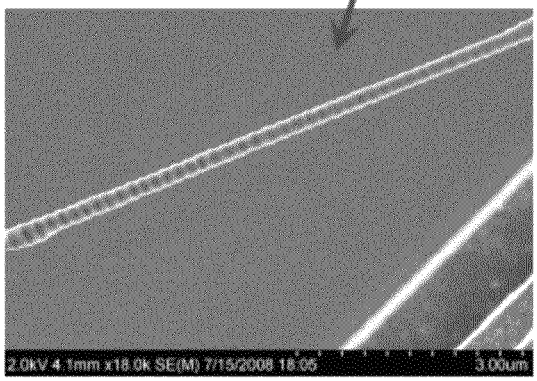
FIG. 19(d)

CARBON NANOFIBERS DERIVED FROM POLYMER NANOFIBERS AND METHOD OF PRODUCING THE NANOFIBERS

RELATED APPLICATION

The present patent document claims the benefit of the filing date under 35 U.S.C. 119(e) of U.S. Provisional Patent Application Ser. No. 61/386,209, filed Sep. 24, 2010, and hereby incorporated by reference in its entirety.

FEDERALLY SPONSORED RESEARCH OR DEVELOPMENT

This invention was made with government support under grant number NSF DMI 0532320 awarded by the National Science Foundation and under grant number N00014-07-1-0888 awarded by the Office of Naval Research. The government has certain rights in the invention.

TECHNICAL FIELD

The present disclosure is related generally to carbon fibers and more specifically to carbon nanofibers derived from organic precursor fibers.

BACKGROUND

Carbon nanofibers are rapidly emerging as multifunctional reinforcement material for composite applications because of their potential for high strength, high elastic modulus, high thermal and electrical conductivity, and low density. Potential applications concern aerospace, automotive, bio-medical, and sporting goods in the form of structural laminate and woven composites to improve matrix toughening.

Carbon fibers can be produced by vapor deposition or from organic precursor nanofibers, such as polyacrylonitrile (PAN) and pitch. Microscale pitch-based carbon fibers have a high modulus and good thermal and electrical conductivities and are thus suitable for a variety of applications. On the other hand, PAN has become the predominant precursor for carbon fiber production due to its high yield and the flexibility of tailoring strength and modulus based on the carbonization and graphitization temperatures. Carbon fibers based on PAN precursors typically have diameters in the range of 5-10 microns.

Attempts to produce PAN-based carbon fibers having nanoscale diameters have met with limited success to date, as the resulting carbon nanofibers are not competitive with micron-scale PAN-derived carbon fibers in terms of mechanical properties.

BRIEF SUMMARY

Described herein is a method to produce polymer nanofibers that may be used as precursors for producing carbon nanofibers. The resulting carbon nanofibers exhibit excellent mechanical properties and may serve as ideal reinforcement materials for strengthening and stiffening nanocomposites.

The method includes providing (a) a solution comprising a polymer and a solvent, (b) a nozzle for ejecting the solution, and (c) a stationary collector disposed a distance d apart from the nozzle. A voltage is applied between the nozzle and the stationary collector, and a jet of the solution is ejected from the nozzle toward the stationary collector. An electric field intensity between about 0.5 kV/cm and about 2.0 kV/cm is maintained as the jet is ejected, where the electric field intensity is defined as a ratio of the voltage to the distance d. A significant portion of the solvent from the jet is evaporated, and one or more polymer nanofibers are deposited on the stationary collector as the jet impinges thereupon. Each polymer nanofiber has an average diameter of about 500 nm or less and may serve as a precursor for carbon nanofiber production.

Also described in this disclosure is a polymer nanofiber that has a substantially uniform density in a radial direction, an average diameter of about 500 nm or less, and a molecular orientation factor f of at least about 50% with respect to a longitudinal axis of the nanofiber.

Also set forth is a carbon nanofiber comprising a length of at least about 1 mm and a diameter of about 500 nm or less, where the carbon nanofiber exhibits a tensile strength of at least about 2 GPa.

In addition, a nanofiber having a modulated surface is described. The nanofiber may be a polymer nanofiber that is used as a carbon fiber precursor. The nanofiber includes an elongated structure comprising a core portion and a shell portion overlying the core portion, wherein the shell portion is more brittle than the core portion. An outer surface of the shell portion exhibits a series of ripples extending along a length of the elongated structure.

BRIEF DESCRIPTION OF THE DRAWINGS

FIG. 1(*b*) is a transmission electron microscope (TEM) image showing a range of carbon nanofiber diameters and their cross-sectional uniformity without evidence of a skin-core structure;

FIG. 4(*b*) illustrates the mechanical behavior of PAN nanofibers fabricated by different electrospinning conditions, where the legend entries are (in order) voltage (kV), electrospinning distance (cm) and nanofiber diameter (nm);

FIG. 5(*b*) shows FTIR spectra of as-spun PAN nanofibers, PAN nanofibers stabilized at 300° C. and PAN nanofibers carbonized at 800° C.;

FIG. 7(*b*) shows an engineering stress-strain curve from a single carbon nanofiber carbonized at 1400° C.;

FIG. 8(*b*) shows average carbon nanofiber strength versus carbonization temperature;

FIG. 8(*c*) shows elastic modulus data versus carbon nanofiber diameter;

FIG. 8(*d*) shows average elastic modulus versus carbonization temperature;

FIG. 19(*a*) shows a matrix for a parametric study of optimal electrospinning conditions for fabrication of corrugated (modulated) PAN nanofibers and PAN nanofibers with homogeneous cross section and quite uniform radial molecular density and FIG. 19(*b*) shows the same electrospinning conditions as in (a) presented in the form of average electric fields; The arrows in (b) point to the resulting PAN nanofiber for different fabrication conditions.

FIG. 19(*c*) shows a homogeneously deformed PAN nanofiber fabricated under condition #5 and FIG. 19(*d*) shows multiple surface ripples formed on a PAN nanofiber fabricated at 20-25 kV and a short distances between the syringe and the target, e.g., 15 cm, as indicated by the red circle on the right on FIG. 19(*b*);

DETAILED DESCRIPTION

Figure 1A:
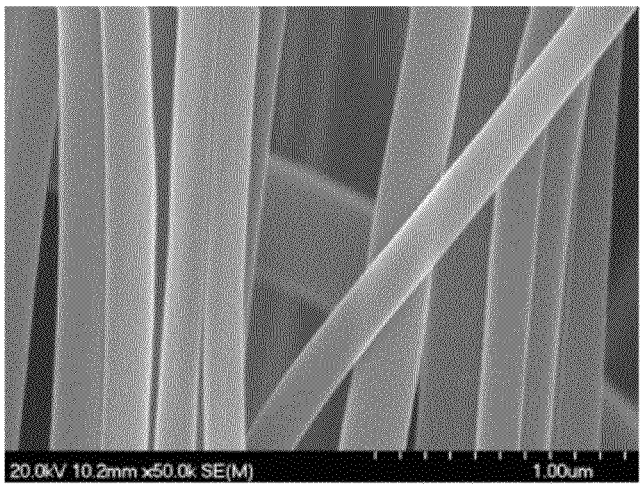
FIG. 1(*a*) is a scanning electron microscope (SEM) image of carbon nanofibers.
Figure 1B:
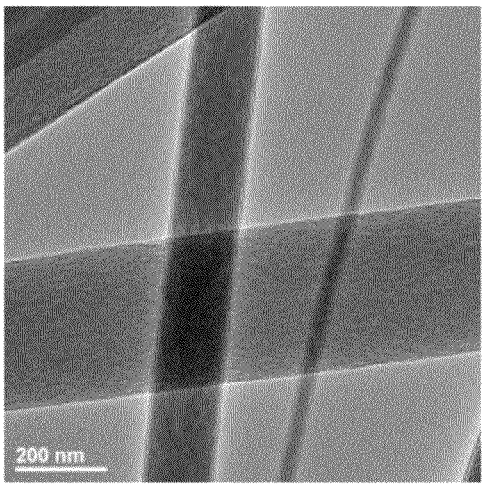

Carbon nanofibers derived from electrospun polymer nanofibers (e.g., polyacrylonitrile (PAN) nanofibers) as described in this disclosure are long, continuous, and straight (e.g., see FIGS. 1(*a*) and 1(*b*)) with excellent mechanical properties. Such carbon nanofibers may serve as ideal reinforcement materials for strengthening and stiffening of nanocomposites.

The experimental results reported here for carbon nanofibers are the first of their kind as a function of processing temperatures, where manufacturing conditions that maximize the mechanical properties of the carbon nanofibers have been identified. The results were corroborated with transmission electron microscope (TEM) images that provide information about the size and distribution of graphite crystallites in individual carbon nanofibers. The crystallite size and density define the mechanical strength and modulus of the carbon nanofibers. There are no previous reports on continuous carbon nanofibers fabricated from electrospun precursors that are in the 100-300 nm diameter range and have strengths and moduli comparable to those of micron-size carbon fibers. Also described in this disclosure are electrospinning process conditions suitable for producing polymer nanofibers having high molecular orientation, as well as a method of making core-shell polymer nanofibers that upon mechanical extension acquire permanent modulated (rippled) surfaces.

Figure 2:
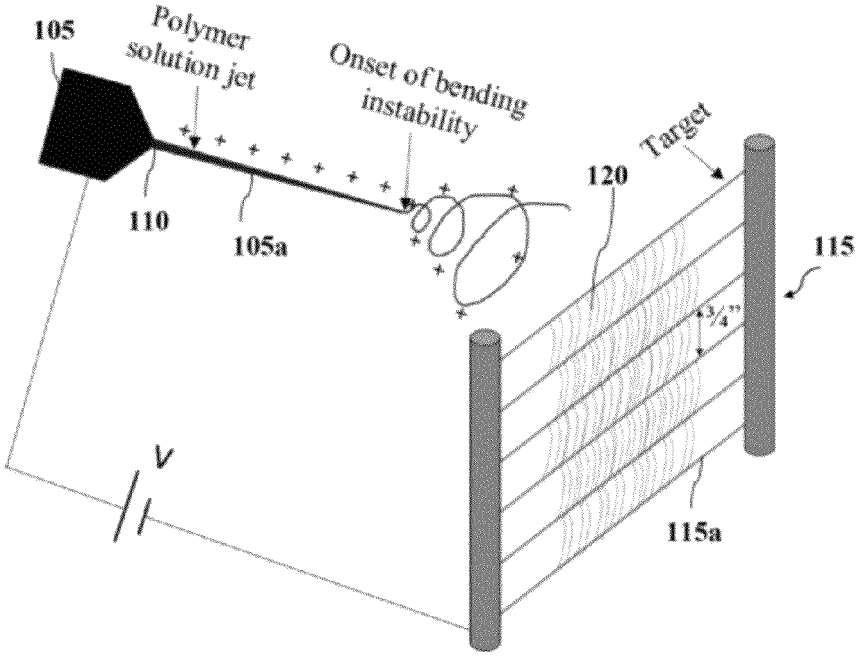
FIG. 2 is a schematic of an electrospinning arrangement to fabricate polymer nanofibers.

A method of making such carbon nanofibers and the polymer nanofibers from which they are derived is described in reference to FIG. 2. The polymer nanofibers are prepared by an electrospinning process. The method entails providing a solution 105 that includes (a) a polymer and a solvent, (b) a nozzle 110 for ejecting the solution 105, and (c) a stationary collector (e.g., a wireframe collector) 115 disposed a distance d apart from the nozzle 110. The stationary collector 115 may be grounded and may include a number of parallel metal wires 115*a*, where the spacing between adjacent wires 115*a* is, for example, about 2 cm.

A voltage is applied between the nozzle 110 and the stationary collector 115, and a jet 105*a* of the solution 105 is ejected from the nozzle 110 in a direction toward the stationary collector 115. An electric field intensity of between about 0.5 kV/cm and about 2.0 kV/cm is maintained as the jet 105*a* is ejected, where the electric field intensity is defined as a ratio of the voltage to the distance d. The electric field intensity may also lie between about 0.8 kV/cm and about 1.7 kV/cm. During its travel towards the stationary collector 115, the jet 105*a* undergoes several instabilities whereby the diameter of the jet 105*a* decreases and at least a portion (typically a substantial amount) of the solvent evaporates. One or more polymer nanofibers 120 are deposited on the stationary collector 115 as the jet 105*a* impinges thereupon, as shown schematically in FIG. 2. The polymer nanofiber(s) may be continuous and aligned. Each polymer nanofiber has an average diameter of about 500 nm or less (e.g., between about 100 nm and about 300 nm), and each nanofiber may have a length in the range of millimeters to centimeters (e.g., at least about 1 mm). Typically the polymer is polyacrylonitrile (PAN).

To produce polymer nanofibers having a substantially uniform density in a radial direction (i.e., through-thickness), the distance d between the nozzle and the stationary collector is preferably at least about 25 cm and the electric field intensity is advantageously between about 0.8 kV/cm and about 1.2 kV/cm. To produce polymer nanofibers having a nonuniform density (e.g., a core-shell structure as discussed further below), the distance d is preferably about 20 cm or less and the electric field intensity may be between about 1.3 kV/cm and about 1.7 kV/cm or higher.

Depending on the electrospinning conditions, the polymer nanofiber(s) may have an orientation factor f of at least about 50% with respect to its longitudinal axis, where the orientation factor (or molecular orientation factor) f represents the degree of molecular orientation or alignment. For example, conditions of electric field intensity of 1.0 kV/cm and distances between the nozzle and the stationary collector of 25 cm may be suitable for forming such polymer nanofibers. The nanofibers may also exhibit a degree of crystallinity of at least about 16%.

After electrospinning, the polymer nanofiber(s) may be removed from the stationary collector for further processing. For example, the polymer nanofiber may be cold drawn to further decrease its diameter in a uniform or nonuniform fashion. Nanofibers with uniform density in a radial direction may result in thinner nanofibers of uniform cross-section upon cold drawing. Nanofibers with a core-shell structure can have periodic surface fluctuations along their length depending on the applied strain rate. For example, and as discussed in greater detail below, slower strain rates (e.g., less than $2.5\cdot10^{-2}$ $s^{-1}$) promote uniformity, whereas faster strain rates (from about $2.5\cdot10^{-2}$ $s^{-1}$ to about 100 $s^{-1}$) lead to polymer nanofibers with a modulated surface.

Figure 3A:
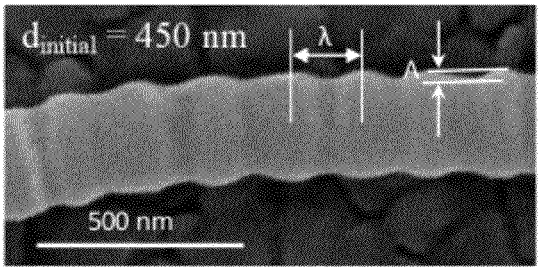
FIG. 3(*a*) is a post-drawing image of a polyacrylonitrile (PAN) nanofiber with a modulated surface, and FIGS. 3(*b*) and 3(*c*) show wavelength and amplitude, respectively, of surface ripples as a function of nanofiber diameter, where all scale bars correspond to 500 nm and all nanofibers were stretched at the strain rate of $2.5 \cdot 10^{-3}$ $s^{-1}$.
Figure 3B:
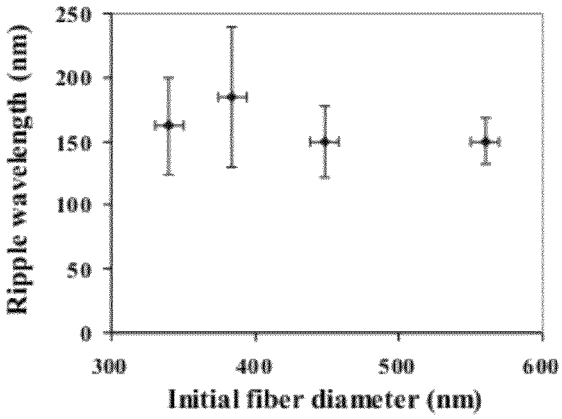
Figure 3C:
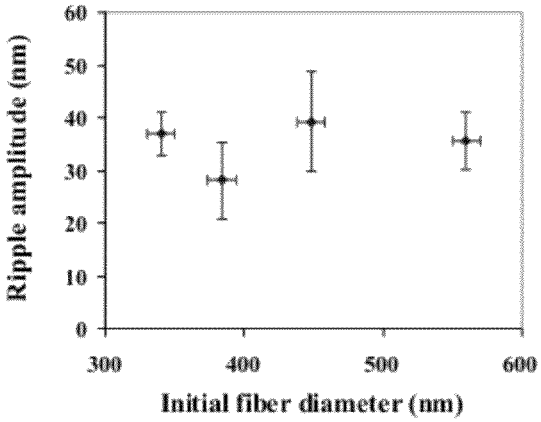

Such surface-modulated polymer nanofibers may include a core portion and a shell portion overlying the core portion, where the shell portion is more brittle than the core portion and includes a series of ripples extending along a length of the nanofiber, as shown for example in FIG. 3(*a*). Adjacent ripples may have an average spacing between about 100 nm and about 250 nm, where the average spacing is the average center-to-center distance between the ripples. The ripples may have an amplitude of between about 10 nm and about 60 nm or between about 20 nm and about 50 nm, on average. The spacing and amplitude of the periodic surface ripples depends on the thickness of the nanofiber shell. The surface-modulated polymer nanofiber, which may be a PAN nanofiber, may have a thickness (diameter) of about 500 nm or less and a length ranging from millimeters to centimeters. A core-shell structure can also be formed with co-axial electrospinning of different polymers or the same polymer but of different solution density. Carbon nanofibers derived from such surface-modulated polymer nanofibers (or the polymer nanofibers themselves) may be effective as composite reinforcements without the need for surface modification. Such nanofibers may also be used to form yarns, where the surface ripples facilitate interlocking of adjacent strands.

The procedure for transforming polymer nanofibers into carbon nanofibers generally involves stabilization, carbonization and graphitization. The first step is stabilization, which may entail heating the polymer nanofibers in air under tension, typically at a temperature between about 300° C. and about 320° C. A ramp rate of 5° C./min may be used to reach the stabilization temperature, which may be maintained for about 30 minutes to 90 minutes (e.g., for about 1 hour). During stabilization, the polymer nanofiber undergoes cyclization which makes it denser and more stable for a subsequent high temperature carbonization treatment.

Stabilized polymer nanofibers are typically carbonized at a temperature between about 800° C. and about 1700° C., during which time the carbon content increases dramatically, producing an amorphous structure with partial crystallinity. High modulus carbon nanofibers may be obtained by further heating at a temperature between about 2000° C. and about 3000° C., during which time the graphitic content increases monotonically with temperature.

Carbon nanofibers prepared as described herein are substantially straight and continuous with a length ranging from millimeters to centimeters (e.g., at least about 1 mm) and a diameter of about 500 nm or less, with most of nanofibers having diameters between 100-250 nm. The optimized carbon nanofibers further exhibit a high tensile strength of at least 2 GPa, and for certain processing conditions, average strength values of about 3.5 GPa and a Young's modulus of at least 100 GPa (e.g., an average value of about 190 GPa). In some cases, the Young's modulus may be about 170 GPa or higher, or even 250 GPa or higher, and the tensile strength may be as high as 4.9 GPa.

Example 1

Fabrication and Characterization of Carbon Nanofibers

In order to fabricate PAN nanofibers, polyacrylonitrile (Sigma Aldrich) with molecular weight $M_w$=150,000 g/mol was dissolved in N,N-dimethylformamide (Sigma Aldrich) at room temperature for 24 hours to form a 9 wt. % solution. A custom-built electrospinning apparatus with a high voltage power supply was used to spin the PAN solution, as shown in FIG. 2. The electrospinning voltage and the distance to the collector were varied between 15-25 kV and 15-25 cm, respectively, and individual PAN nanofibers were tested under each condition.

Based on the mechanical property results from individual PAN nanofibers discussed below, only those fabricated at 25 kV and 25 cm distance from the collector were stabilized and carbonized because they had the highest elastic modulus, tensile strength, and molecular orientation factor. Continuous PAN nanofibers were collected on the grounded parallel steel wires of the collector with 1 cm spacing, thus forming a unidirectional net of fibers. The PAN nanofibers were picked-up from the collector on metallic clips designed to thermally expand with increased temperature and, therefore, maintain tension on the nanofibers during stabilization and carbonization in graphite molds.

Stabilization of PAN nanofibers was conducted in a furnace by heating in air from room temperature to 300° C. at a rate of 5° C./min and 1 hr hold time at the peak temperature.

The optimal temperature and time of stabilization were determined by differential scanning calorimetry (DSC).

Four sets of PAN nanofibers, stabilized at optimal conditions, were carbonized in a high temperature tube furnace for 1 hr in a $N_2$ atmosphere and at peak temperatures of 800° C., 1100° C., 1400° C. and 1700° C. A heating rate of 5° C./min was used in carbonization to reach the desired temperature directly. The PAN and carbon nanofibers were inspected for uniformity and surface defects under a scanning electron microscope (SEM), while transmission electron microscopy (TEM) was employed to investigate the nanofiber structure at different carbonization temperatures and to measure the average turbostratic carbon crystallite thickness. Turbostratic carbon resembles graphite but the graphene sheets are rather wavy and not fully parallel to each other.

A microelectromechanical (MEMS)-based nanoscale testing platform with a high resolution optics-based method for mechanical property experiments at the nanoscale, developed to test individual polymer and carbon nanofibers, was used to obtain stress versus strain curves of individual PAN and carbon nanofibers.

Figure 4A:
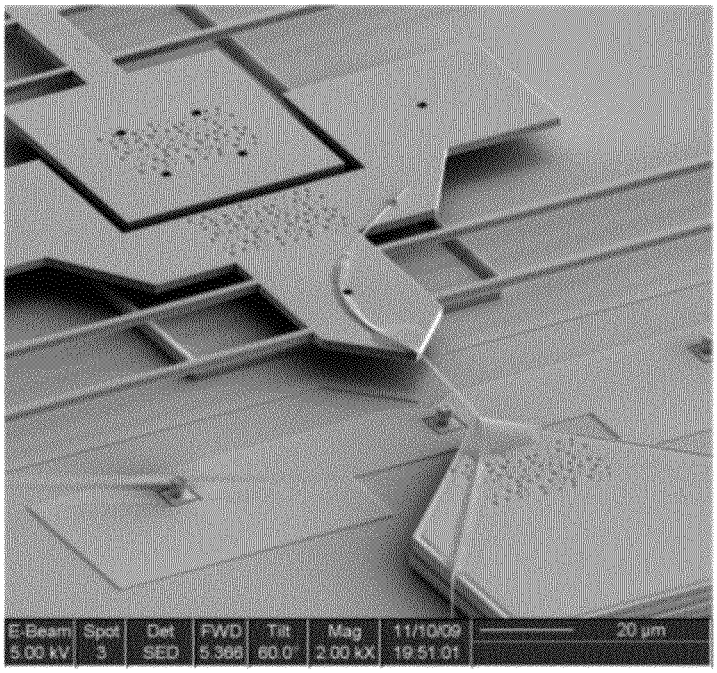
FIG. 4(*a*) shows a PAN nanofiber mounted on a MEMS loading platform for mechanical testing.
Figure 4B:
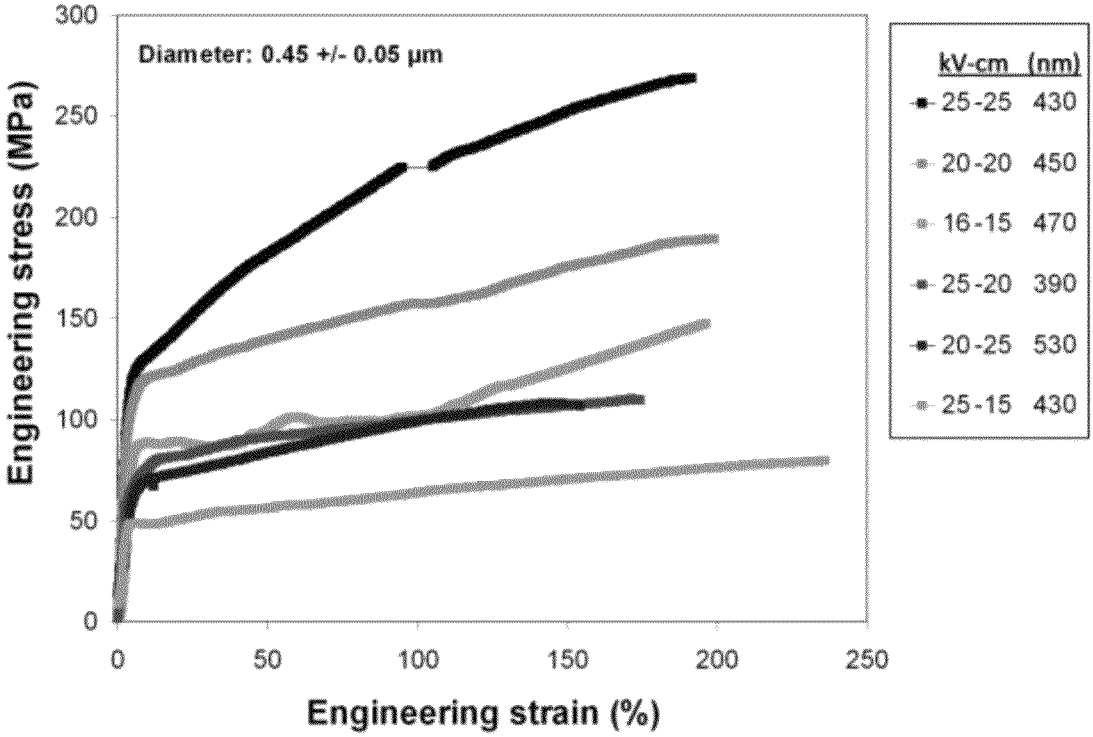

FIG. 4(*a*) shows a PAN nanofiber mounted on the MEMS platform for nanofiber testing. A focused ion beam (FIB) was used to deposit Pt at both ends of the carbon nanofiber before testing to ensure rigid mounting. The MEMS platform was actuated by an external piezoelectric device and images of the loadcell opening and the distance between the grips (i.e., change in the nanofiber length) were recorded concurrently by a CCD camera at 400× optical magnification as described by Naraghi, et al. As part of this method, digital image correlation (DIC) analysis was performed to calculate the loadcell opening and the nanofiber extension with displacement resolution of 25 nm. The loadcell stiffness was measured by a traceable method of suspending glass spheres of known weights while recording the corresponding loadcell openings.

FIG. 4(*b*) shows the effect of different electrospinning parameters on the elastic-plastic mechanical response of PAN nanofibers. The figure legend includes the PAN nanofiber diameters which were reduced by about 50% after carbonization. Nanofibers spun at an average electric field of 1 kV/cm had higher elastic modulus, yield strength and similar ductility as those fabricated at higher electric field intensities. Furthermore, nanofibers spun at the longest distances had the highest modulus and tensile strength, which is likely attributable to improved molecular orientation, which is critical for high properties of the derived carbon nanofibers.

Increased molecular orientation was confirmed by FTIR measurements, showing orientation factors that were twice as high (f=0.52) for the nanofibers having the highest mechanical strength in FIG. 4(*b*). Similar orientation factors have been reported from X-ray measurements for microscale PAN fibers used as precursors for carbon fibers. Short electrospinning distances to the collector (e.g., 15 cm) had limited or no molecule-stretching effect and perhaps increased solvent content in the nanofibers, while long electrospinning distances permitted multiple bending instabilities and evaporation of the majority of the solvent, the presence of which promotes (undesirable) molecular relaxations at short electrospinning distances.

Figure 5A:
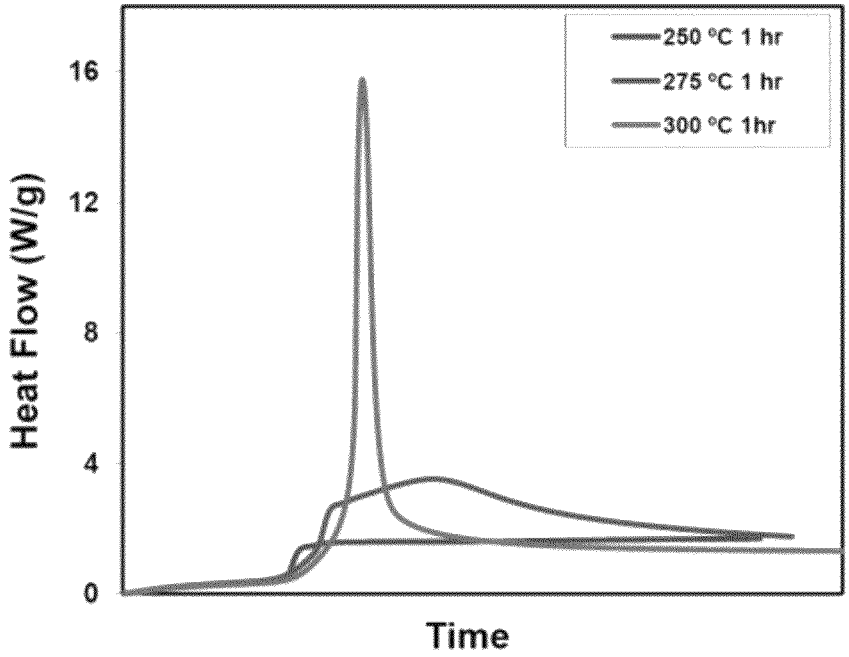
FIG. 5(*a*) shows DSC profiles of PAN nanofibers stabilized at 250° C., 275° C. and 300° C. for 1 hr.
Figure 5B:
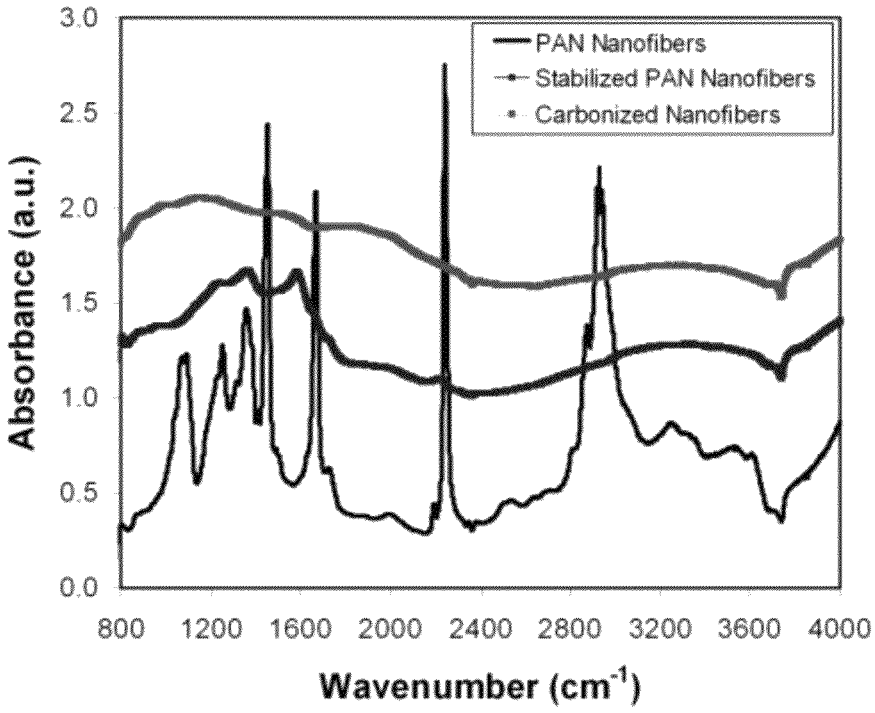
Figure 6A:
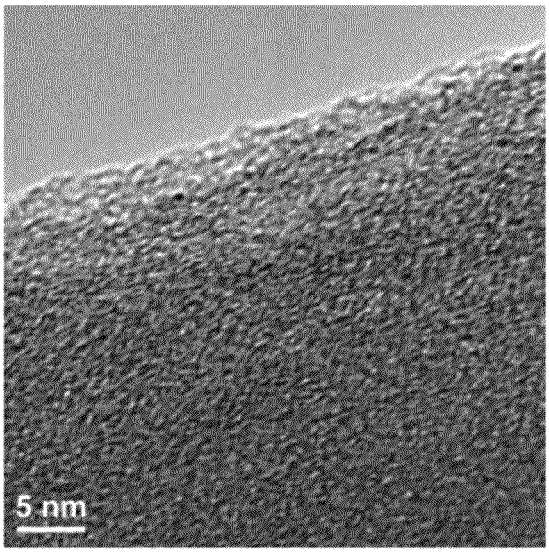
FIGS. 6(*a*)-6(*d*) show images of carbon nanofibers carbonized at (a) 800° C., (b) 1100° C., (c) 1400° C. and (d) 1700° C. showing the increased size and density of turbostratic carbon crystallites.
Figure 6B:
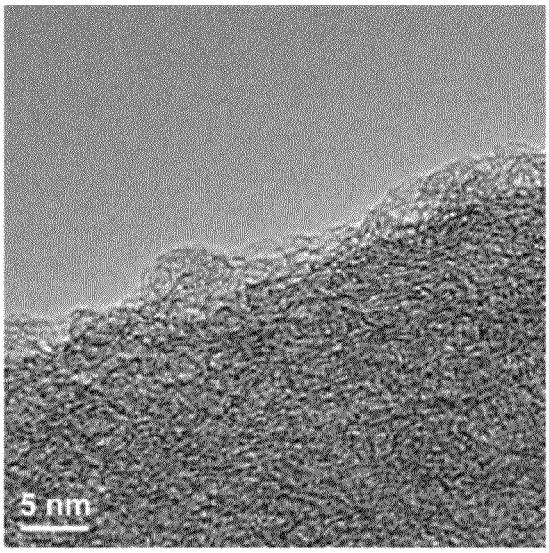
Figure 6C:
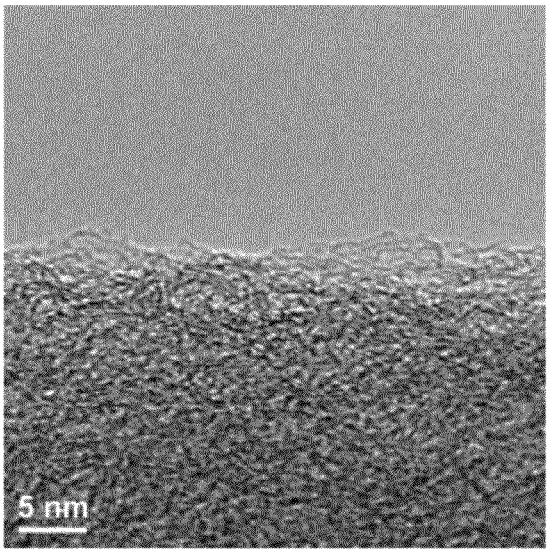
Figure 6D:
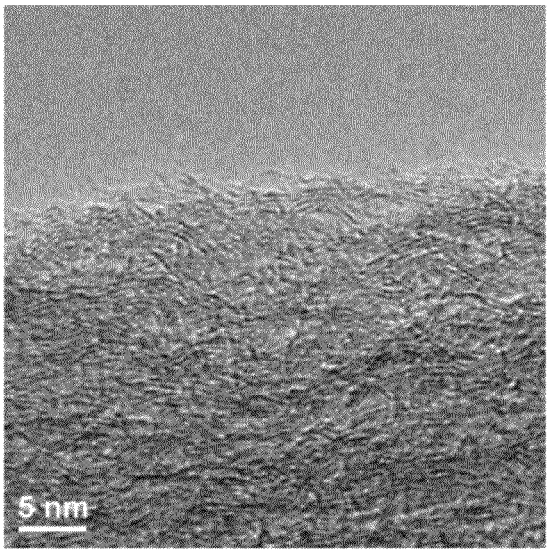

The optimal temperature and time for stabilization were determined by differential scanning calorimetry (DSC). Sample curves are shown in FIG. 5(*a*), where three large samples of PAN nanofibers were heated at 5° C./min to 250° C., 275° C., and 300° C. and held at the peak temperature for 1 hr. Stabilization of PAN is an exothermic reaction and a DSC scan shows the amount of heat released as a function of time and, therefore, the completion of the reaction. The exothermic reaction was not complete at 250° C. and 275° C., and the nanofiber samples continued to release heat even after 1 hr. However, the reaction was completed after 1 hr at 300° C. and the released heat was dramatically more than at 250° C. and 275° C. A second scan was done at 300° C. but no further heat was released, which confirmed that stabilization was completed in first heating cycle. Stabilization temperatures higher than 300° C. can result in combustion of the fibers.

The stabilized nanofibers were then exposed to temperatures in the range of 800-1700° C. to derive the carbon fibers. Fourier Transform Infrared (FTIR) spectra of the as-spun PAN nanofibers and those stabilized at 300° C. and carbonized at 800° C. are shown in FIG. 5(*b*). The characteristic vibrations for the chemical groups in PAN are: at 2241-2243 $cm^{-1}$ due to the C≡N nitrile group, the vibrations of the aliphatic CH groups (CH, $CH_2$, and $CH_3$ bonds) at 2870-2931 $cm^{-1}$, 1450-1460 $cm^{-1}$, 1350-1380 $cm^{-1}$ and 1220-1270 $cm^{-1}$, the strong band at 1732 $cm^{-1}$ is the C═O stretching and the band at 1684 $cm^{-1}$ is due to the amide group. After stabilization, the most prominent structural changes are the reduction of the 2241-2243 $cm^{-1}$ peak intensity, which is attributed to the C≡N nitrile group, the reduction of the intensity of the aliphatic CH groups and the reduction of the peak intensity of the amide group. The appearance of the peak at 1590 $cm^{-1}$ is due to a mixture of C═N, C═C, and N—H groups. Most importantly, C≡N is converted into C═N which results from cyclization and cross-linking and prepares the chemical structure for subsequent high temperature carbonization as reported in previous literature for carbon fibers. The appearance of the C═C group results from dehydrogenation. The FTIR spectra of the carbonized fibers do not contain structural information because the black carbon nanofibers have very high absorbance.

FIGS. 1(*a*) and 1(*b*) show SEM and TEM images of PAN-derived carbon nanofibers. The carbon nanofibers in FIG. 6(*a*) have smooth surfaces and uniform diameters along their length, which is a reason for their high mechanical strength. The diameter of the carbon nanofibers produced by this method can vary between 50-500 nm, with some examples shown in FIG. 1(*b*). The nanofibers are wire-like straight, which is an advantage compared to other carbon nanofibers and nanotubes that are wavy and as a result, do not provide appreciable stiffening to a polymer matrix at strains less than 1-3%. The TEM images of carbon nanofibers in FIGS. 6(*a*)-6(*d*) show the formation of randomly oriented crystallites at all carbonization temperatures, which are more pronounced at 1700° C.

Figure 7A:
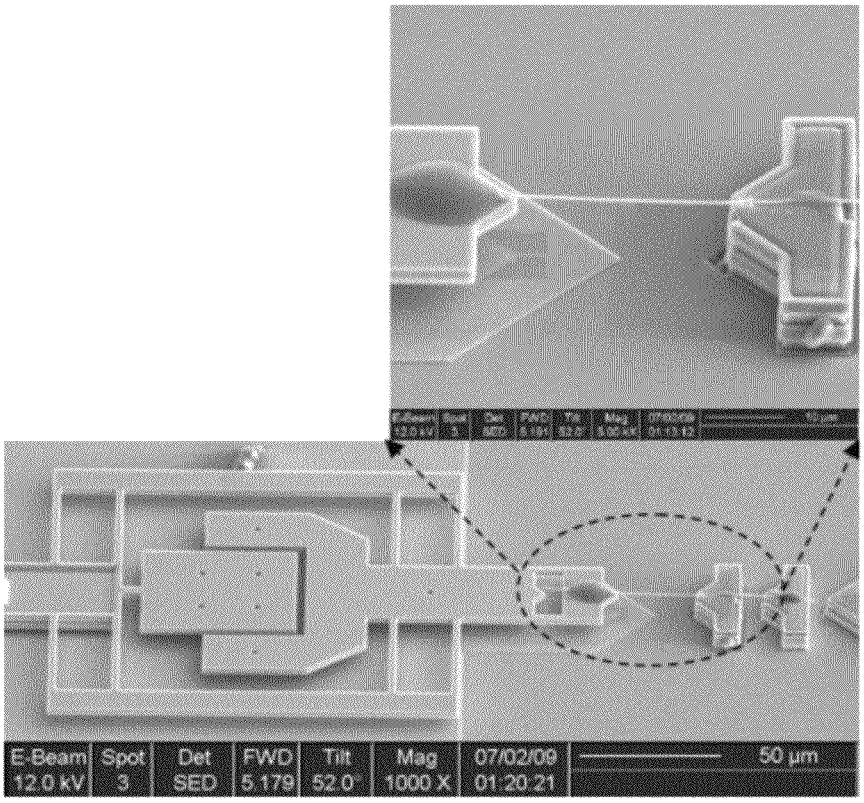
FIG. 7(*a*) shows a carbon nanofiber mounted on a MEMS device for mechanical testing showing a detail of the grips.
Figure 7B:
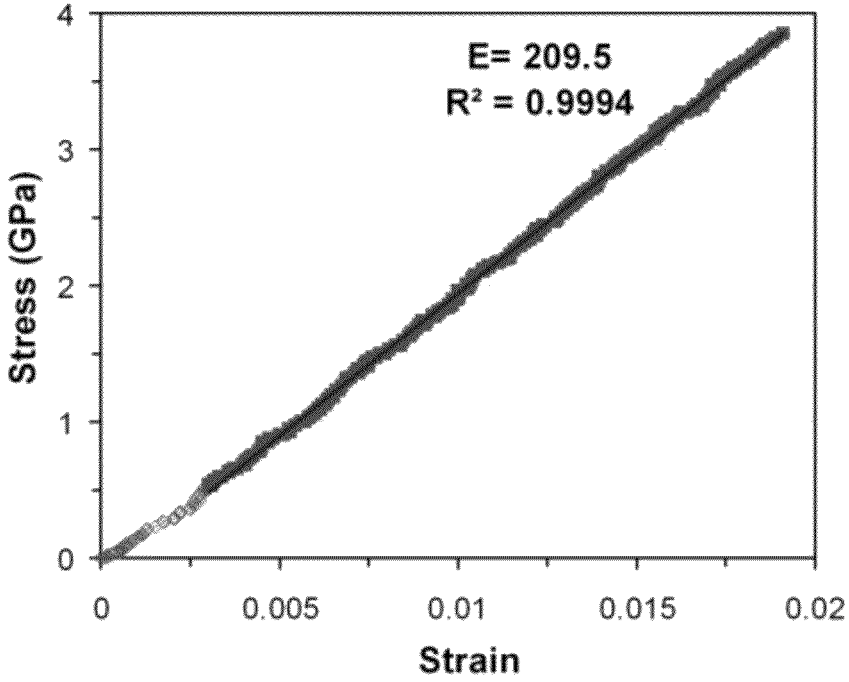
Figure 8A:
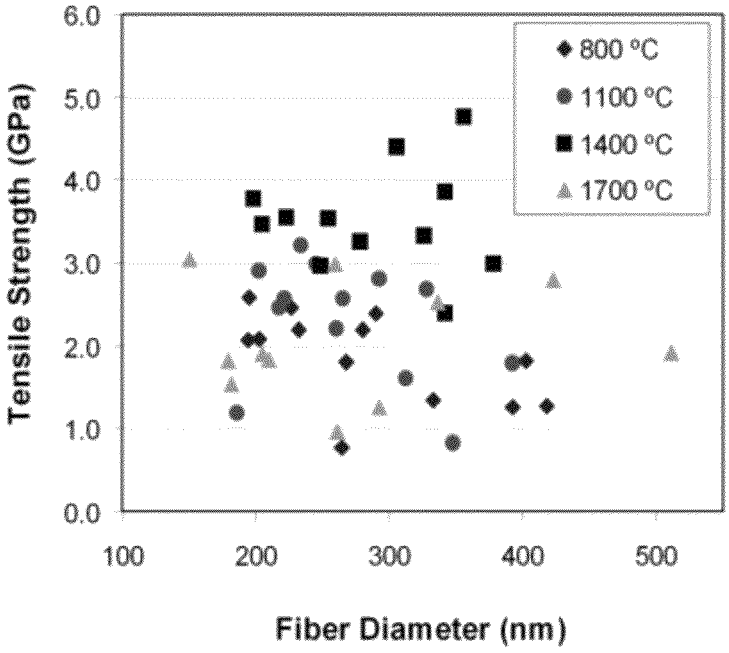
FIG. 8(*a*) shows tensile strength data versus carbon nanofiber diameter for four carbonization temperatures.
Figure 8B:
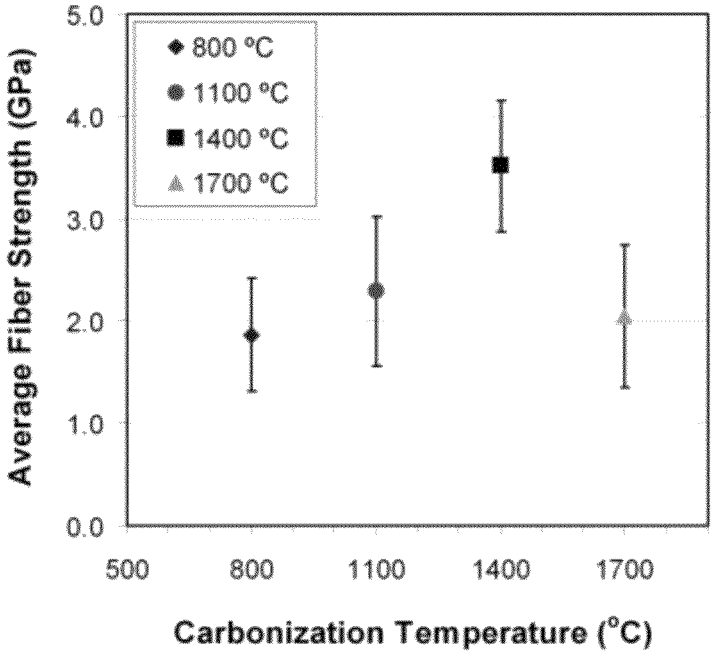
Figure 8C:
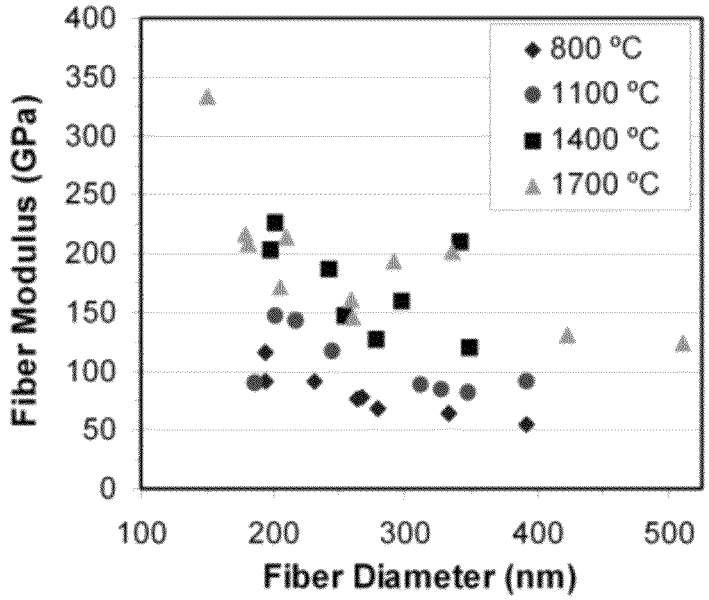
Figure 8D:
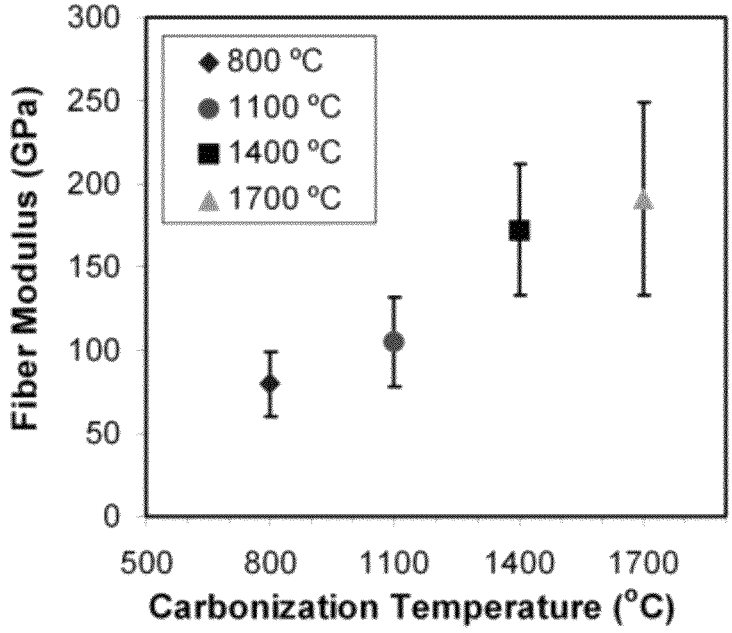

Individual carbon nanofibers were mounted on the MEMS nanofiber testing platform, shown in FIG. 7(*a*), and tested as described in the method by Okzan T., et al. "Mechanical Properties of Vapor Grown Carbon Nanofibers," *Carbon* 48 (2010) 239-244, which is hereby incorporated by reference in its entirety. A representative stress-strain curve of a carbon nanofiber is shown in FIG. 7(*b*). As expected, the nanofibers behaved in a linearly elastic manner starting at zero strain and until their failure at a strain that in some cases approached 2% at strengths that exceeded 4.0 GPa.

The tensile strength vs. diameter for nanofibers carbonized at different temperatures is shown in FIG. 8(*a*). Fibers carbonized at 800° C. and 1100° C. showed a dependence of strength on diameter, with larger diameters resulting in smaller tensile strength values. In FIG. 8(*b*), the average nanofiber strength is plotted as a function of the carbonization temperature to identify the optimal processing conditions for maximum strength, which was achieved at 1400° C. According to FIG. 8(*b*), the tensile strength of carbon nanofibers produced at 1400° C. was independent of the nanofiber diameter. Similarly, the Young's modulus of the carbon nanofibers shows a dependence on the nanofiber diameter for all carbonization temperatures, as indicated in FIG. 8(*c*), and the modulus increases monotonically with temperature as shown in FIG. 8(*d*).

Table I below summarizes all the mechanical and structural properties of the carbon nanofibers as a function of carbonization temperature. A reduction in the nanofiber tensile strength with increasing diameter was observed at the lower carbonization temperatures of 800° C. and 1100° C.: the strength of the nanofibers carbonized at 800° C. increased by almost 100% when the diameter was reduced from 500 nm to 200 nm. TEM images of all carbon nanofibers, as shown for example in FIGS. 1(*b*) and 6(*a*)-6(*d*), revealed no porosity or other discernible defects, except for a nanometer scale surface roughness. It is believed that increased molecular orientation may be the reason for the scale dependent strength and modulus of nanofibers carbonized at 800° C. and 1100° C. At these temperatures the non-carbon elements are removed during carbonization more easily in thinner than in thicker nanofibers. As shown in FIGS. 6(*a*)-6(*b*) and discussed later in this section, the crystallite size at 800° C. and 1100° C. may be too small to affect the scaling of the mechanical properties. Thus, any diameter scaling of the mechanical properties is likely attributable to the properties of the original PAN.

For nanofibers carbonized at up to 1400° C., increasing carbonization temperature resulted in an increase in the fiber strength up to 3.5±0.6 GPa, which is 6 times higher than the average strength reported previously for carbon nanofibers of the same dimensions but carbonized at lower temperatures (1100° C.), or tested in a bundle form. The initial rise in strength with carbonization temperature at 800° C. and 1100° C. may be explained by the increasing carbon content and nanofiber densification.

TEM images of carbon nanofibers produced at all temperatures, e.g., FIG. 1(*b*), show homogeneous cross-sections without any evidence of a skin-core structure. The homogeneity of the present nanofibers is believed to be one of the reasons for the high mechanical property values reported. It is important to note that nanofiber strength was not found to depend on the nanofiber diameter at 1400° C. carbonization temperature.

TABLE I

Mechanical properties and crystallite thickness as a function of carbonization temperature. The standard deviation is provided for each average property value.

| Carbonization Temperature (° C.) | Carbon Content (%) | Young's Modulus (GPa) | Tensile Strength (GPa) | Characteristic Strength $\sigma_c$ (GPa) | Weibull Modulus | Crystallite Thickness (# of layers) |
|---|---|---|---|---|---|---|
| 800 | 81.2 | 80 ± 19 | 1.86 ± 0.55 | 2.20 | 3.1 | 3.3 ± 0.9 |
| 1100 | 92.7 | 105 ± 27 | 2.30 ± 0.70 | 2.90 | 6.4 | 3.9 ± 0.9 |
| 1400 | N/A | 172 ± 40 | 3.52 ± 0.64 | 3.60 | 5.9 | 6.6 ± 1.4 |
| 1700 | N/A | 191 ± 58 | 2.05 ± 0.70 | 2.30 | 3.0 | 7.9 ± 1.9 |

The tensile strength dropped precipitously for nanofibers produced at 1700° C. This reduction in mechanical strength is believed to be due to the evolving crystalline structure shown in FIGS. 6(*a*)-6(*d*): increased carbonization temperature results in growth of the randomly oriented turbostratic carbon crystallites which may cause early fiber rupture as a consequence of the stress mismatch with the surrounding amorphous carbon. The highest stiffness constant of graphite can exceed 1 TPa, which is significantly larger than the average stiffness of the surrounding amorphous carbon. As the two phases are approximately under the same strain, the mismatch stress rises dramatically for larger crystallites, causing crack nucleation and instant brittle fracture.

A large number of TEM images of the carbon nanofibers were obtained to measure the average crystallite thickness, $L_c$, and length, $L_a$, for different carbonization temperatures. $L_c$ and $L_a$ both increased with increasing carbonization temperature: As listed in Table I, the average crystallite thickness increased from an average of 3.3±0.9 layers at 800° C., which is in good agreement with previous reports for micron size diameter, commercial (T-300) and nanoscale fibers, but higher than that reported before by Zhou et al. (Zhou Z, Lai C, Zhang L, Qian Y, Hou H, Reneker D H, Fong H. Development of carbon nanofibers from aligned electrospun polyacrylonitrile nanofiber bundles and characterization of their microstructural, electrical, and mechanical properties. Polymer 2009; 50:2999-3006.) for similar size nanofibers processed between 1000-1400° C., to an average of 7.9±1.9 layers at 1700° C. The average crystallite thickness of microscale PAN derived carbon fibers carbonized at 1800° C. has been reported to be 8-10 carbon layers which is similar to the present values, suggesting that the nanoscale size of the fibers does not affect the growth of the carbon crystallites. It should be noted that the crystallite size for the carbonization temperature of 1100° C. is very comparable to that reported for PAN derived carbon nanofibers with significantly lower tensile strength and modulus, which suggests that the dramatic improvement in the mechanical properties reported in this work can be attributed to the nanofiber homogeneity across its thickness.

Figure 9A:
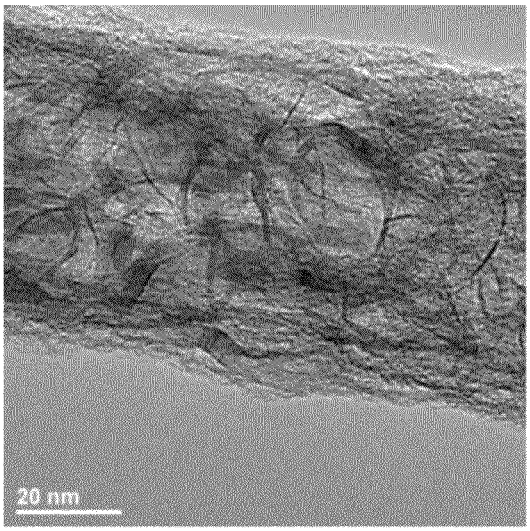
FIGS. 9(*a*) and 9(*b*) show TEM images and detail of a carbon nanofiber carbonized at 1400° C. with large, randomly oriented, crystallites.
Figure 9B:
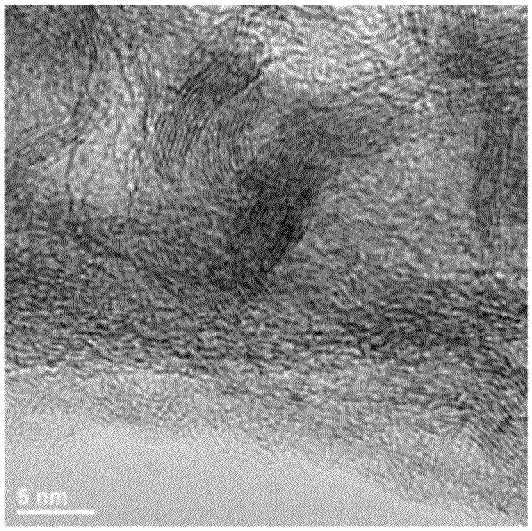

The Young's modulus, on the other hand, depends on the nanofiber diameter for all carbonization temperatures, as shown in FIG. 8(*c*), reaching a maximum average value of 191±58 GPa at 1700° C. While at 800° C. and 1100° C., the scaling of the elastic modulus with diameter could be directly attributed to similar scaling of the PAN nanofiber elastic modulus, at the higher temperatures of 1400° C. and 1700° C., the structure of the nanofibers is dominated by the presence of the turbostratic carbon crystallites, as clearly shown in FIGS. 6(*c*) and 6(*d*). The larger density and size of crystallites at higher temperatures resulted in a "composite" nanofiber with higher stiffness. The scaling of the modulus with nanofiber diameter at 1400° C. and 1700° C. could be due to increased density and size of crystallites at and near the nanofiber surface compared its interior, especially for thicker fibers. However, it was not possible to measure the crystallite size and distribution in the interior of nanofibers thicker than 100 nm with a TEM. It was evidenced, however, that some very thin nanofibers with diameters 50-100 nm had large crystallite density and sizes in their interior, as shown in FIGS. 9(*a*) and 9(*b*). It should be noted that even in the thinnest nanofibers, the crystallites were not aligned with their axis.

The tensile strength and the elastic modulus of the present carbon nanofibers were 6 and 3 times larger than previously reported PAN derived and other forms of carbon nanofibers as a result of selecting optimal conditions for PAN electrospinning. More importantly, the commercial carbon T-300 (Toray Industries, Inc) have mechanical strength of 3.53 GPa, which is very close to that reported here for PAN nanofibers carbonized at the same temperature as the T-300 fibers, namely 1400° C. Finally, it is worth mentioning the force-bearing capacity of the nanofibers reported here exceeds that of other forms of nanoscale carbon such as CNTs. PAN nanofibers carbonized at 1400° C. with 200 nm diameter carried at least 50 μN of force before failure, which is 20 times higher than the 2.68 μN sustained by 26 nm diameter (gage length of 2.1 μm) as-grown multi-walled carbon nanotubes (MWCNTs), and comparable that of 49 nm diameter (gage length of 1.9 μm) irradiated MWCNTs that have been reported to sustain 60.5 μN (Locascio M., et al., Tailoring the load carrying capacity of MWCNTs through inter-shell atomic bridging, *Exp. Mech.* 49 (2009) 169-182).

The carbon nanofibers were brittle and potential extrapolations of their failure properties could be made by fitting the Weibull probability density function to the strength data, which yields the two Weibull parameters: the characteristic strength, $\sigma_c$, and the Weibull modulus m. Their values are tabulated in Table I. As the characteristic strength increased from 2.2 GPa to 3.6 GPa for nanofibers produced between 800° C. and 1400° C., the Weibull modulus also increased to about 6, which is an average value for brittle materials. The Weibull modulus provides a measure of the distribution and variability of the flaw sizes in a material. Large values (>10-15) indicate small dependence of the mechanical strength on the specimen size and, therefore, for large values of m, a well-defined flaw size and distribution exist. Small values of m (<5-6) indicate a diverse population of flaws in size and/or in orientation. The mechanical strength scales with the specimen size as $\sigma_1/\sigma_2=(l_2/l_1)^{1/m}$, where $\sigma_1$ and $\sigma_2$ are the failure strengths of specimens with "sizes" $l_1$ and $l_2$, respectively. $l_1$ and $l_2$ may denote the specimen length, surface area or volume depending whether the flaws that cause failure are evenly distributed along the specimen length, its surface or its volume. It is evident from this equation that for m≈6 (fibers produced at 1400° C.) the nanofiber strength scales rather weakly with its length.

Example 2

Fabrication and Characterization of PAN Nanofibers

PAN nanofibers were electrospun in ambient conditions from 9 wt. % solution of PAN in dimethylformamide (DMF) on a stationary target comprised of metal grids with 2 cm spacing as shown in FIG. 2. Three different source-to-target distances of 15 cm, 20 cm and 25 cm were used while maintaining constant electric field of 1 kV/cm by applying a voltage of 16 kV, 20 kV and 25 kV respectively. The common electric field intensity of 1 kV/cm provided an equivalent driving force on the polymer jet. The electric field intensity is expected to affect the jet velocity, the jet elongational strain rate, and the evolution of molecular orientation in the resulting nanofibers. In addition, the electrospinning distance affects the solvent content as the nanofibers reach the target, since longer electrospinning distances at similar electric field intensities allow for longer travel times during which solvent may leave the fiber surface. Similarly, the order and duration of bending instabilities taking place during the jet travel are controlled by the electrospinning distance. As known in the art, electric charge imbalance in the traveling jet leads to lateral deflection of the jet, known as the first order electrical bending instability, while further travel of the jet, accompanied by jet thinning and further electrostatic charge induction, results in higher order instabilities which further contribute to the process of solvent reduction and to an increase in jet viscosity, which can induce molecular shearing and stretching.

Figure 16A:
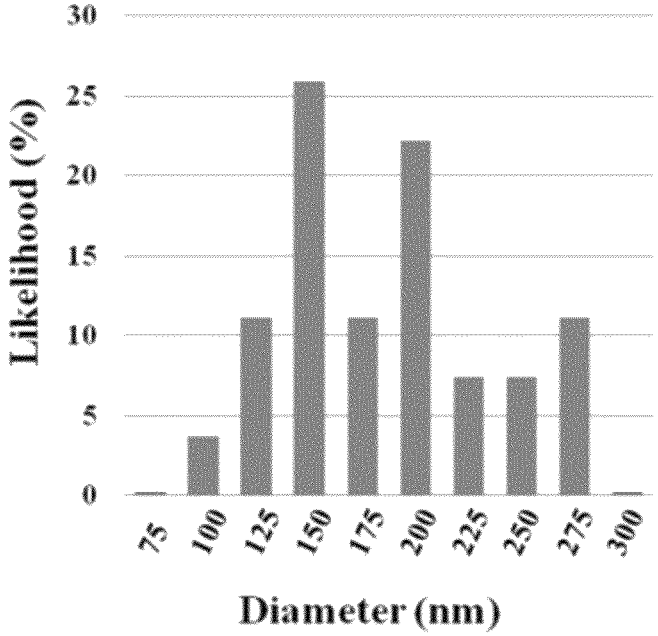
FIGS. 16(*a*)-16(*c*) show the distribution of PAN nanofiber diameters fabricated at 1 kV/cm and at electrospinning distances (a) 15 cm, (b) 20 cm, and (c) 25 cm.
Figure 16B:
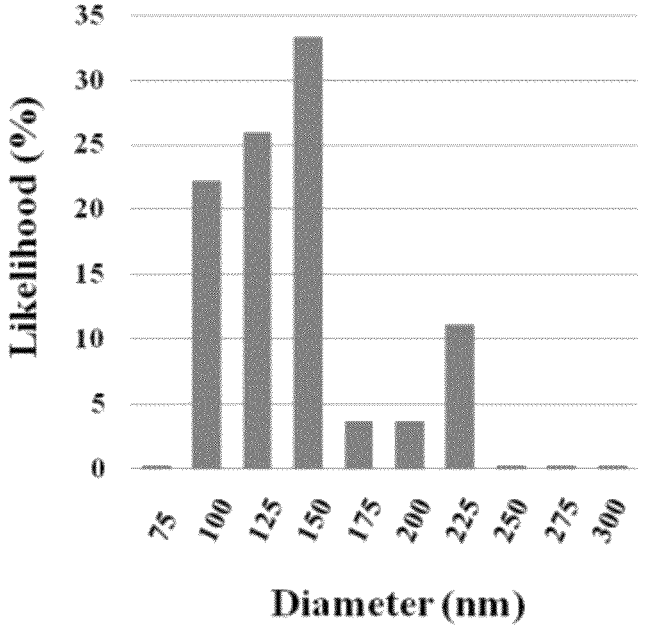
Figure 16C:
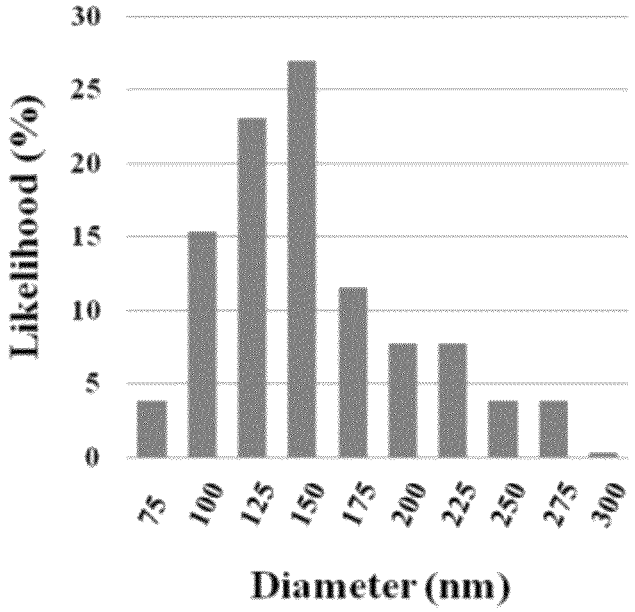

The elastic modulus and the yield stress of individual PAN nanofibers were measured at the strain rate 0.025 $s^{-1}$ with a MEMS-based nanomechanical testing platform developed previously (see FIG. 4(*a*)) and the elastic moduli were compared with those reported before by several sources for bulk PAN. For each fabrication condition, a minimum of 14 individual nanofibers with diameters between 200-700 nm were tested. As discussed further below, this range of nanofiber diameters is not representative of their diameter distribution, which was almost exclusively in a narrow range of 125-275 nm as shown in FIG. 16(*a*)-FIG. 16(*c*). Fiber isolation and testing were performed in ambient conditions under an optical microscope, and imaging by a scanning electron microscope (SEM) took place after the mechanical experiments to avoid fiber damage due to e-beam radiation.

Figure 10:
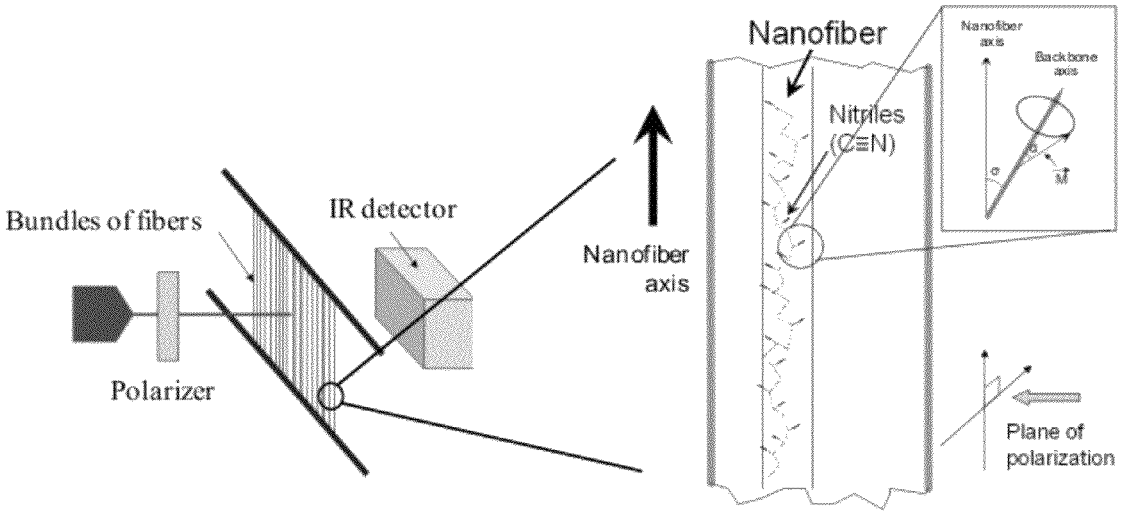
FIG. 10 is a schematic showing the application of polarized FTIR spectroscopy on aligned bundles of PAN nanofibers, where the measurement takes advantage of the rigid angle between the nitrile group and the PAN backbone (α) shown in the inset (the schematic of the oriented PAN molecule in a nanofiber was adapted from Z. Bashir et al., *Polym. Int.* 1994; 33:9-17, which is hereby incorporated by reference)

High resolution transmission electron microscopy (TEM) images of PAN nanofibers in the form of relatively well aligned mats were taken by a JEOL 2100 Cryo TEM. Molecular orientation was determined by polarized FTIR spectroscopy (Thermo Nicolet Nexus 670, wavelength range 100-3,000 $cm^{-1}$, resolution 0.125 $cm^{-1}$), In this method, a bundle of aligned PAN nanofibers, with thickness of the order of tens of microns, was irradiated with a polarized IR beam perpendicularly to the nanofibers' axis and the IR transmission spectrum was obtained when the plane of polarization was parallel and perpendicular to the fiber direction, as shown in FIG. 10. This technique benefits from the approximately 70° rigid angle of the nitrile group with respect to the PAN backbone axis.

Finally, WAXD analysis was carried out on PAN bundles in directions 0°, 45° and 90° with respect to the direction of the nanofibers, to obtain an estimate of the average degree of crystallinity in the nanofibers. A PANalytical X'pert MRD system was used with Cu radiation wavelength of 0.154 nm. The instrument was operated at 45 kV-40 mA with a crossed-slit collimator in the primary optics, a parallel plate collimator in the secondary optics, a flat graphite monochromator and a proportional detector. Data processing and peak area calculations were carried out with MDI JADE 9.3.

Figure 11:
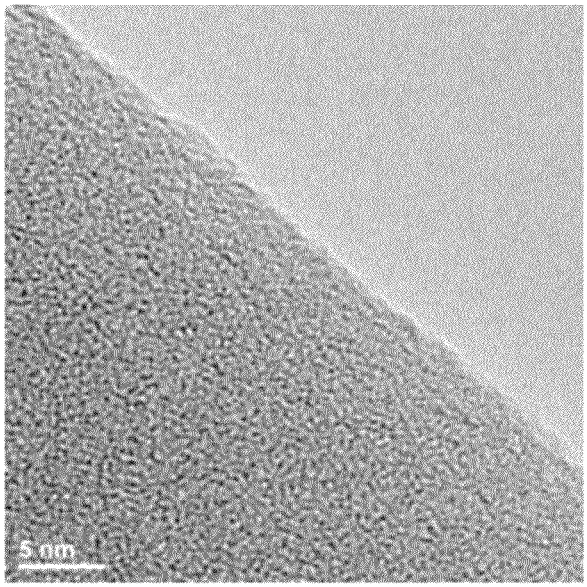
FIG. 11 is a high resolution TEM image of a 150 nm diameter PAN nanofiber showing its very smooth surface and the lack of core-shell structure.

The PAN nanofibers fabricated under all conditions had smooth surfaces and homogeneous cross-sections as evidenced in TEM images and shown in FIG. 11. High resolution TEM images of thin (150 nm diameter) and thick (500 nm diameter) nanofibers showed no evidence of structural order or crystallinity. Furthermore, no voids or porosity were evidenced in any of the fibers.

Figure 12A:
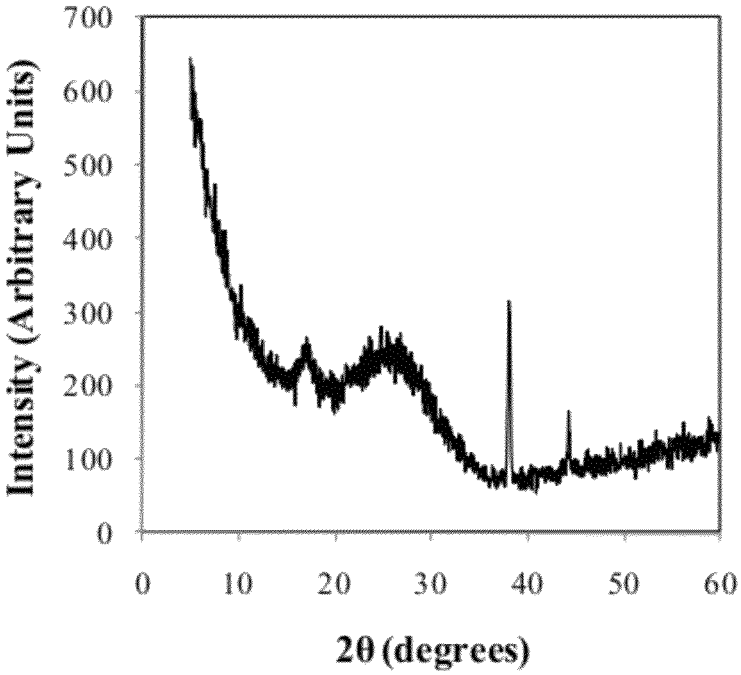
FIGS. 12(*a*)-12(*c*) show WAXD curves obtained in the direction of aligned PAN nanofiber mats fabricated at (a) 15 kV and 15 cm, (b) 20 kV and 20 cm, and (c) 25 kV and 25 cm, where the peaks at 38° and 44° are from the metal nanofiber holder.
Figure 12B:
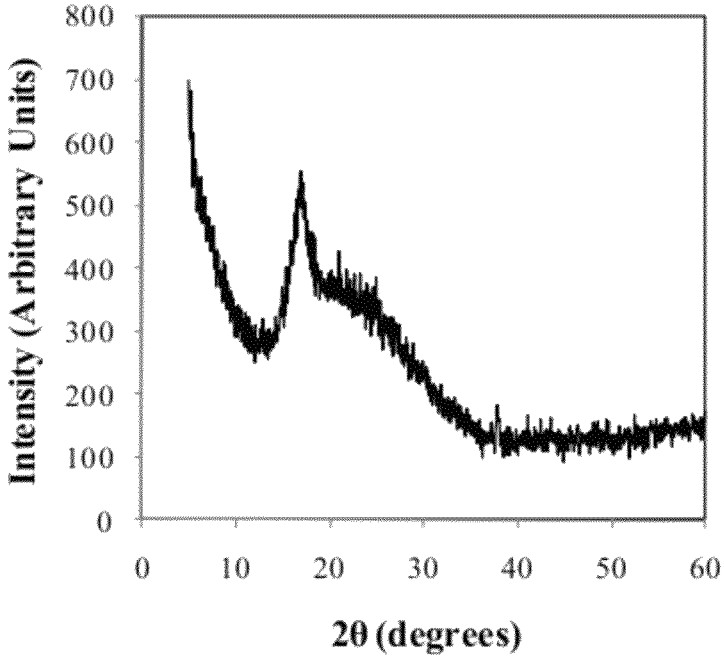
Figure 12C:
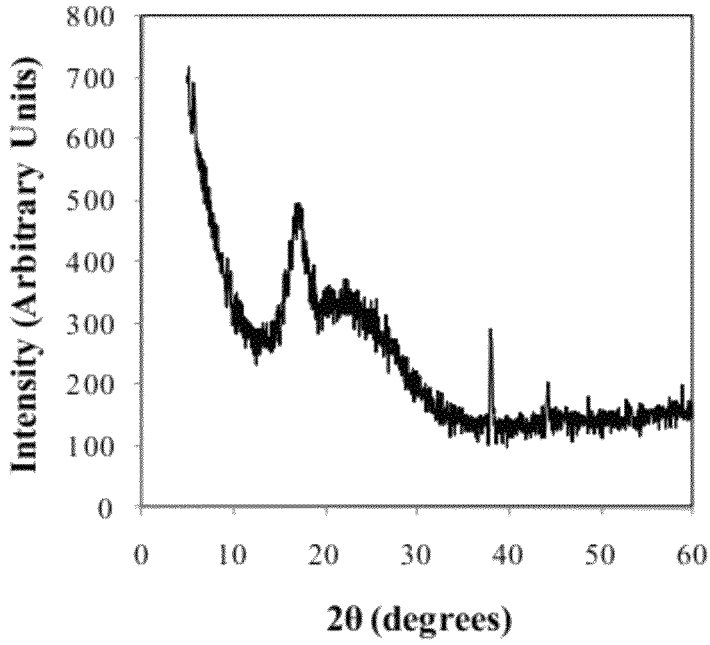

WAXD scans were obtained along the fiber orientation in PAN mats, equatorial scans are shown in FIGS. 12(*a*)-12(*c*), and at 45° and 90° with respect to the fiber orientation. The WAXD scans had a relatively broad peak at 2θ≈17° which was used to calculate the degree of crystallinity as the average of the values at azimuthal angles of 0°, 45° and 90° by using the method of peak areas. The areas under the diffraction peaks were calculated using MDI Jade 9.3 and Matlab. The average degree of crystallinity of nanofiber samples collected at 15 cm target distance was 7.3%, while the crystallinity of the nanofiber samples collected at 20 cm and 25 cm distances were 16.5% and 16.8%, respectively. Thus, the longer travel distance favors crystallinity in PAN nanofibers, but in a non-monotonic manner.

Figure 13A:
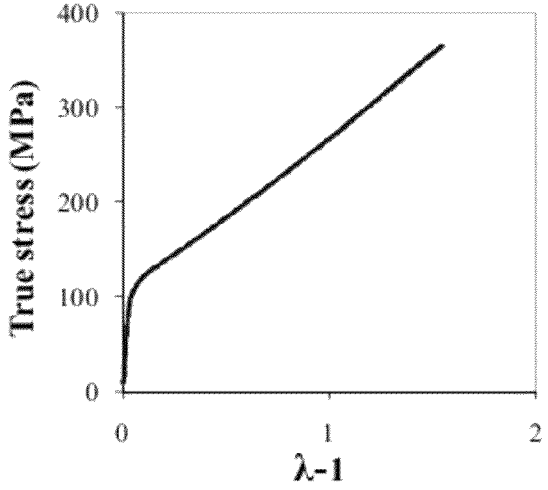
FIGS. 13(*a*) and 13(*b*) show true stress vs. stretch ratio, λ, of a PAN nanofiber for (a) large and for (b) small extensions, where the plots correspond to a sample fabricated at 16 kV, 15 cm (d) with 250 nm diameter.
Figure 13B:
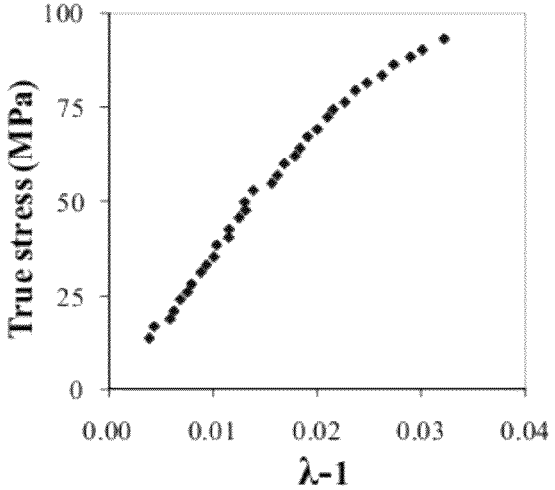

The mechanical behavior of individual PAN nanofibers fabricated under the conditions listed in Table 2 was investigated by the experimental method described in M. Naraghi, et al., *Y. Rev. Sci. Instrum.* 2007; 78 (085108): 1-8, which is hereby incorporated by reference in its entirety. Due to the large deformations imposed on the nanofibers the engineering stress vs. strain curves were converted into true stress vs. stretch ratio curves. The fiber stretch ratio is the ratio of the deformed length of the nanofiber to its initial length, while the true stress was calculated by multiplying the engineering stress by the stretch ratio, assuming volume conservation during inelastic deformation (i.e., no void formation):

$$\frac{A_0}{A_{deformed}} = \lambda \tag{1}$$

$$\begin{aligned}\sigma_{True} &= \frac{F_F}{A_{deformed}} \\ &= \frac{F_F}{A_0} \cdot \frac{A_0}{A_{deformed}} \\ &= \sigma_{Engineering} \frac{A_0}{A_{deformed}} \\ &= \lambda \sigma_{Engineering}\end{aligned}$$

where A, σ, λ and F are the fiber cross section, the average stress, the stretch ratio and the applied force, respectively. An example of a true stress-stretch ratio curve is shown in FIG. 13(*a*) with a detail view at small nanofiber extensions shown in FIG. 13(*b*).

Figure 14A:
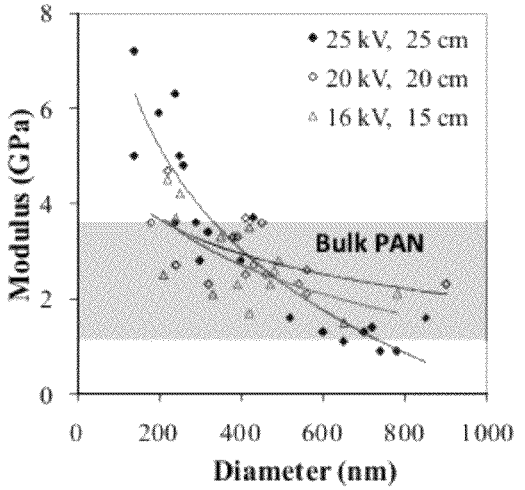
FIGS. 14(*a*) and 14(*b*) show (a) elastic modulus and (b) yield strength vs. PAN nanofiber diameter for the three electrospinning conditions shown in the legends, where the range of modulus values for bulk PAN is shown in the shaded region in 14(*a*).
Figure 14B:
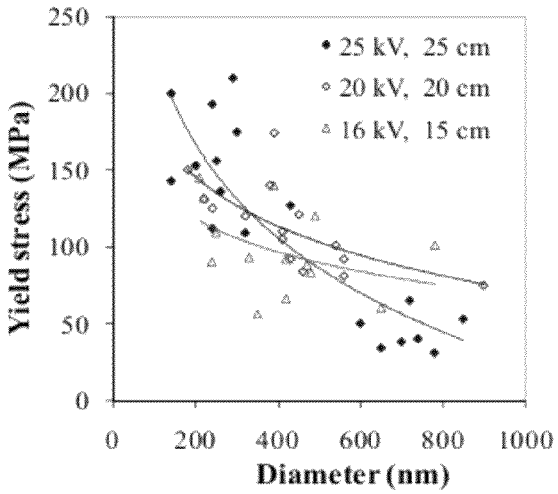

The mechanical experiments revealed that the ultimate strain depended weakly on the initial nanofiber diameter. Therefore, the elastic modulus and yield strength were used as metrics of the properties of the nanofibers that depended strongly on their initial structure and the fabrication conditions. For all fabrication conditions, both the elastic modulus and the yield stress decreased with fiber diameter. FIG. 14(*a*) shows a comparison of the elastic modulus values with bulk PAN whose elastic modulus is similar to that of the thickest fibers. The elastic modulus of bulk PAN has been reported in literature to be in the range of 1.1-3.5 GPa. The elastic modulus of the nanofibers spun at all distances converges towards the bulk values for large nanofiber diameters, pointing to very low molecular alignment and crystallinity. More importantly, the sensitivity of the elastic modulus and yield strength, FIG. 14(*b*), on diameter is highly dependent on the electrospinning distance: the longest distance of 25 cm resulted in the strongest diameter size effect, while the shorter distances of 20 and 15 cm showed a rather marginal effect, especially in terms of yield strength.

Figure 15:
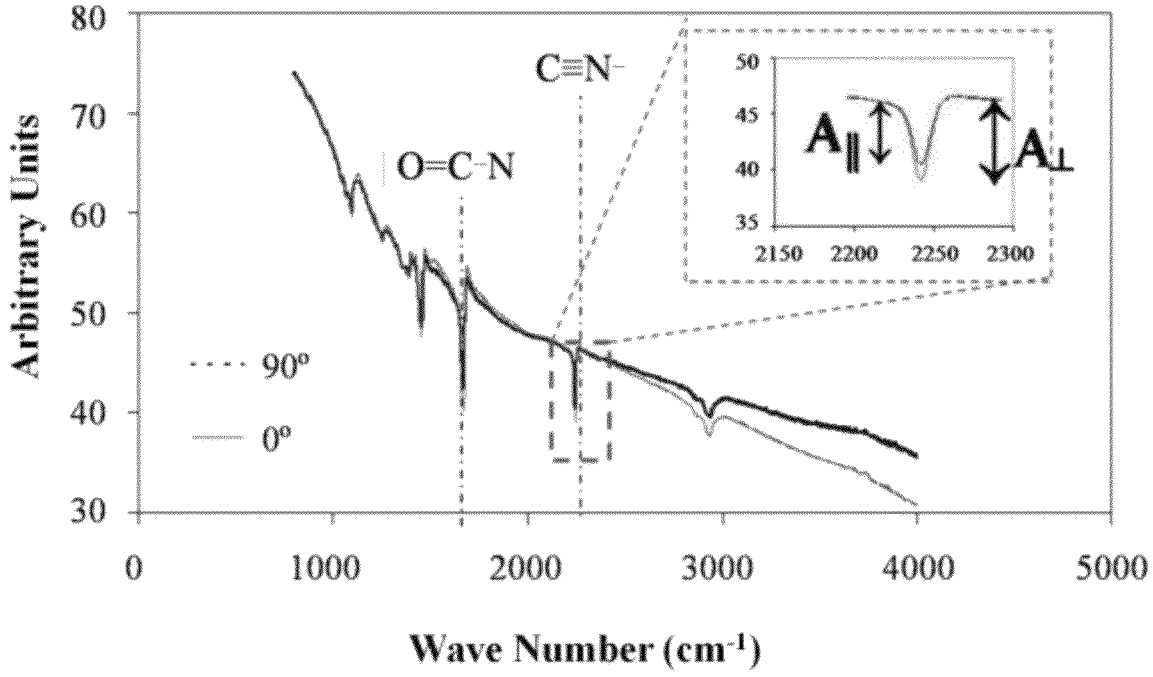
FIG. 15 shows an FTIR spectrum from a mat of aligned PAN nanofibers, spun at 20 cm from the target, and oriented 0° and 90° with respect to the IR detector, where the peak at 2240 $cm^{-1}$ corresponds to the nitrile group and the peak at 1630 $cm^{-1}$ corresponds to the amide group in DMF, which indicates the presence of solvent molecules (the orientation factor is calculated from the relative area under the two peaks of the nitrile group shown in the insert)

A polarized FTIR absorption spectrum is shown in FIG. 15. The degree of molecular alignment, described by the orientation factor f, can be calculated from the relative strength of the transmission peak at 2240 $cm^{-1}$, corresponding to the nitrile group, when the plane of polarization of the light are perpendicular, $A^{\perp}$, and parallel, $A\|$, to the fiber axis:

$$f = \frac{3}{2}\langle\cos^2\sigma\rangle - \frac{1}{2} = \frac{(D-1)(D_0+2)}{(D_0-1)(D+2)} \tag{2}$$

$$\text{with } D = \frac{A\|}{A\perp} \text{ and } D_0 = 2\cot^2\alpha$$

where α is the average angle between the polymer chain backbone and the nitrile group, here approximately 70°, and σ is the average angle between the backbones of the PAN molecules and the nanofibers axis. The orientation factor, f, lies between 0 and 100%, with the two limits corresponding to randomly oriented and fully aligned molecules with respect to the fiber axis, respectively. As a reference, macroscale PAN fibers, with relatively low molecular alignment induced by drawing, may have orientation factors of about 50-60%.

The results of the FTIR analysis are shown in Table 2. The degree of molecular alignment was the highest for the longest electrospinning distance of 25 cm compared to 15 cm and 20 cm, while the difference between the latter two was insignificant. Given that the bundles contained nanofibers with different diameters, the FTIR measurements reflected the cumulative IR absorption spectrum of all fiber diameters. In order to better relate the FTIR data with the elastic moduli reported in FIG. 14(*a*), one must consider the relative contribution of nanofibers with different diameters to the FTIR absorption spectrum. The histogram data in FIGS. 16(*a*)-16(*c*) are from more than 30 SEM images per fabrication condition, each image containing up to 5 fibers. Nanofibers thicker than 300 nm were so rare that they were not observed in these random SEM images. Therefore, the diameter distribution in the mechanical property data in FIGS. 14(*a,b*) is not representative of the true diameter distributions in the fiber mats, which were mainly in the range 100-300 nm.

TABLE 2

Electrospinning conditions and molecular properties of PAN nanofibers

| Sample # | Electrospinning distance d (cm) | Applied voltage (kV) | Electric field intensity (kV/cm) | Orientation factor f (%) | Degree of crystallinity (%) |
|---|---|---|---|---|---|
| 1 | 15 | 16 | 1 | 50% | 7.3 |
| 2 | 20 | 20 | 1 | 22% | 16.5 |
| 3 | 25 | 25 | 1 | 21% | 16.8 |

Figure 17:
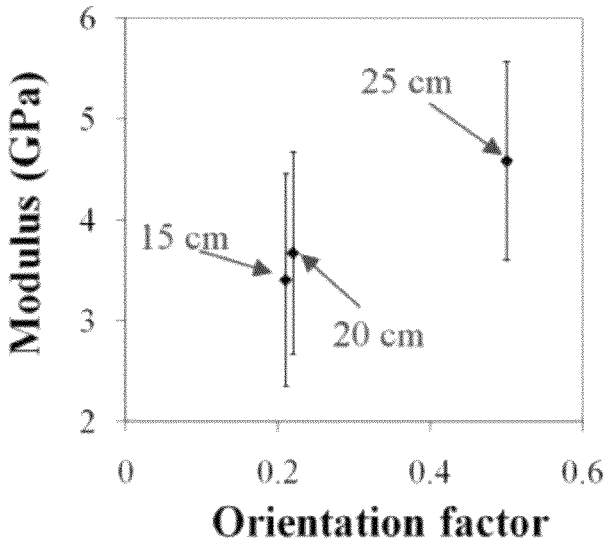
FIG. 17 shows elastic modulus vs. orientation factor for PAN nanofibers with diameters smaller than 300 nm for the diameter distributions shown in FIGS. 16(*a*)-16(*c*)

The mechanical properties in conjunction with the orientation factor measurements in Table 2 point out to distinctly higher molecular orientation in PAN nanofibers fabricated at the longest electrospinning distances of 25 cm, compared to 20 cm and 15 cm. The increased molecular orientation and mechanical properties can be attributed to a combination of processes taking place during electrospinning: Firstly, longer travel distances of the polymer jet and, therefore, longer travel times, result in larger convective solvent loss and, thus, higher viscosity of the jet. Increased viscosity allows for higher shear stresses and, thus, allows for increased molecular orientation. Longer travel distances are likely to induce higher order instabilities too, which may dramatically increase the travel time of the jet and thus, the loss of solvent. Secondly, very small solvent content when the fibers reach the collector helps to maintain their molecular orientation. Since the vast majority of nanofibers were in the small diameter range (<300 nm), the orientation factor is also related to small diameter nanofibers which resulted in high elastic modulus and yield strength. In contrast, nanofibers fabricated at short distances retained more solvent, which resulted in molecular relaxation while resting at the collector. This correlation between the elastic modulus of thin nanofibers and the orientation factor is evident in FIG. 17. Each datum point is the average of the elastic moduli of the nanofibers in FIG. 14(*a*) with the diameters smaller than 300 nm, which are relevant to the FTIR data. Therefore, the longest electrospinning resulted in nanofibers with improved molecular orientation and hence enhanced mechanical properties.

Longer polymer jet travel distances also resulted in improved crystallinity. As shown in Table 2, electrospinning for the shortest distance of 15 cm resulted in a low crystallinity of about 7%. Longer distances (20 cm and 25 cm) resulted in the same degree of crystallinity of about 16%, potentially due to the degree of entanglement and loss of mobility taking place beyond a 20 cm of jet travel. These trends in crystallinity do not agree, however, with the trends in the mechanical properties and the orientation factor. The PAN crystals for such small crystallinity values are of the order of 1-2 nm with a very short range effect on the load transfer from the amorphous to the crystalline phase, which, in turn, does not support a major improvement in the elastic modulus and the yield strength. The effect of molecular orientation is of long range and by far stronger, thus supporting a significant increase in the mechanical properties.

Figure 18:
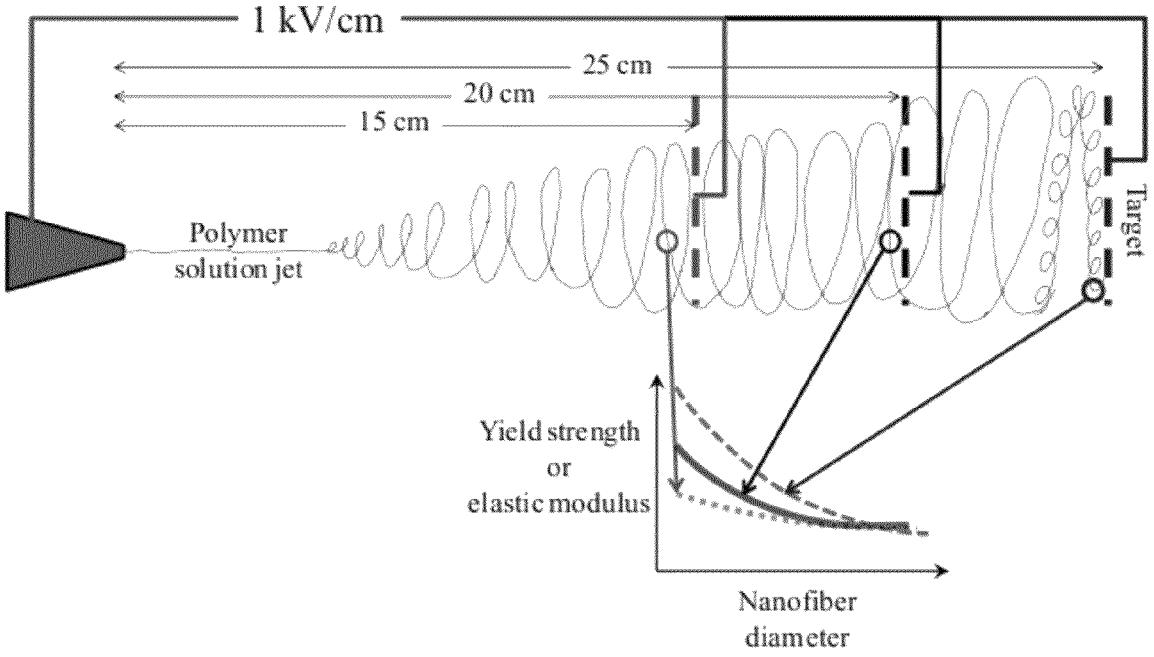
FIG. 18 shows a schematic of the relationship between mechanical properties and PAN nanofiber diameter and electrospinning parameters.
Figure 20A:
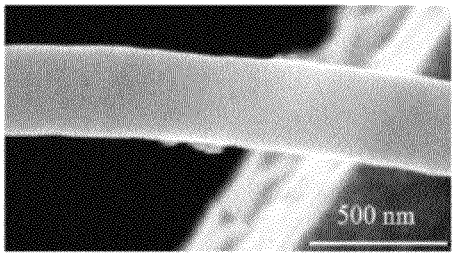
FIGS. 20(*a*)-20(*d*) show an (a) undeformed PAN nanofiber with an initially smooth surface, (b) surface (skin) cracking which started at 20% strain, (c) surface cracks in (b) induce localized deformation and periodic surface rippling, and (d) broken fiber with permanent surface rippling.
Figure 20B:
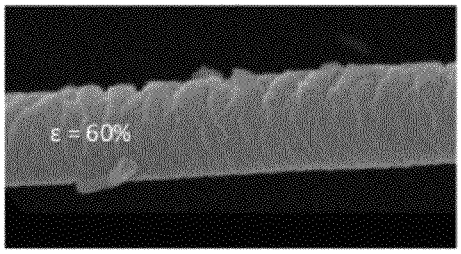
Figure 20C:
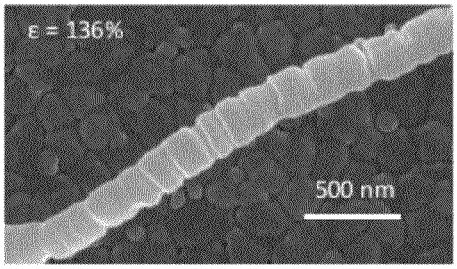
Figure 20D:
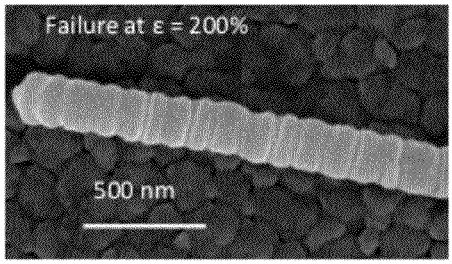

As shown in FIGS. 16(*a*)-16(*c*), electrospinning at distances between 15 cm and 25 cm resulted in similar diameter distributions. Therefore, a major portion of the stretching and elongation of the jet which transformed the polymer jet into thin nanofibers appears to have occurred within the first 15 cm of electrospinning. The jet elongation has been considered responsible for molecular alignment in nanofibers, which, as shown in the mechanical property trends in FIGS. 14(*a*)-14(*b*), nanofiber thinning and molecular orientation are not so intimately related. This is because short electrospinning distances favor larger solvent content which can reduce molecular alignment by molecular relaxation. The presence of solvent in as-spun nanofibers is confirmed by the peak at 1630 $cm^{-1}$ in the FTIR spectrum in FIG. 15, which corresponds to the amide group in the DMF molecule. It should be noted, however, that the solvent content at the instant the fibers are deposited on the collector is even higher, as solvent evaporation continues after deposition on the target. On the other hand, the significant convective solvent loss before the nanofibers meet the collector at the longest electrospinning distance immobilizes the oriented PAN macromolecules, resulting in 50% orientation factor in as-spun nanofibers. This evolution of nanofiber properties during electrospinning is schematically shown in FIG. 18.

While the aforementioned discussion explains the increase in mechanical property values with electrospinning distance, the strong property size effect for the thin nanofibers and the largely invariant mechanical properties of thick fibers spun at all distances still require an explanation. In an analogy to dry spinning, molecular orientation is not constant across the fiber cross-section, as the polymer molecules near the surface are denser and often oriented along the nanofiber axis, while the polymer molecules in the nanofiber core are more disordered and are surrounded by solvent molecules. In the process of electrospinning, longer electrospinning distances allow for significant convective solvent loss at the fiber surface due to the high jet velocities. This convective solvent loss is mitigated by its diffusion (at slower rate) from the nanofiber core through an increasingly densified surface shell whose thickness largely independent of the fiber diameter. As a result, thinner nanofibers with higher surface-to-volume ratios have reduced solvent content and higher molecular orientation reflected in their increased yield strength and elastic modulus. This competition between convective loss and diffusion of solvent may result in a variety of inhomogeneous fiber cross-sections, including a core-shell whose thickness may depend on the jet travel time and its velocity.

As shown in FIG. 14(*a*), the elastic modulus of some thick PAN nanofibers with diameters of ≥600 nm are comparable to or lower than bulk PAN. The mechanism of surface evaporation vs. intrafiber diffusion of solvent permits the formation of a solvent rich core surrounded by a hard polymer dense shell. Therefore, the lower modulus of the thickest PAN nanofibers fabricated at all conditions is the composite modulus of a compliant core protected by a stiff shell. For fiber diameters of the order of a few microns, this competition between solvent diffusion and convective loss could lead to highly porous structures with a radically reduced stiffness and a susceptible to a variety of shell instability modes that result in wrinkled surfaces. In the present case however, TEM images showed no signs of porosity and smooth nanofiber surfaces, which points to at most a graded structure with small solvent residues in the nanofiber interior, which is also indirectly supported by the fact that the elastic modulus and yield strength were higher or at most comparable to bulk values.

In summary, single nanofiber mechanical experiments in conjunction with FTIR and WAXD spectroscopy were applied to electrospun PAN nanofibers to investigate the existence of molecular orientation due to key electrospinning parameters. The results pointed out that molecular orientation is imparted at the later stages of the electrospinning process when the polymer jet viscosity increases and bending instabilities take place. Nanofibers with diameters smaller than 300 nm produced at the longest electrospinning distance demonstrated the highest molecular orientation factor (50%), elastic modulus and yield strength. Shorter electrospinning distances, although producing the same distribution of nanofiber diameters, resulted in insignificant molecular orientation (21-22%) and mechanical property values not significantly different from bulk PAN. This insignificant molecular orientation and the bulk-like properties were attributed in part to molecular relaxations due the presence of solvent in the nanofibers reaching the collector at small distances.

Wide angle x-ray diffraction (WAXD) studies pointed to very limited crystallinity that increased with the electrospinning distance in a non-monotonic manner indicating that crystallinity and molecular orientation, as measured by FTIR, do not evolve simultaneously. The degree of crystallinity in nanofibers spun at the shortest distance was merely 7%, and it assumed constant value of 17% for the intermediate and the longest electrospinning distances. Hence, it is concluded that the electrospinning distance may control molecular orientation by dictating the order of the bending instabilities the nanofibers are subjected to, as well as the effectiveness of these instabilities in orienting the polymer molecules in the presence of solvent in the nanofibers.

Example 3

Fabrication of Nanofibers with Modulated Surfaces

A parametric investigation was carried out to determine appropriate conditions to fabricate PAN nanofibers with modulated surfaces, e.g., fibers with a periodic surface waviness, which may promote their adhesion or the adhesion of their carbonized form inside polymer matrices. The effect of average electric field (kV/cm) and distance between the syringe 110 and the collector 115 was tested. SEM imaging of PAN nanofibers fabricated under sample conditions #1-7 in FIGS. 19(*a*) and 19(*b*) showed that the fabricated nanofibers had smooth surfaces with little variation in diameter along their length. Regardless of the initial surface condition of nanofibers, the evolution of their surface morphology during uniaxial drawing depended on the electrospinning conditions.

Nanofibers spun at an electric field of 1 kV/cm, upon stretching at strain rates $10^{-4}$-200 $s^{-1}$, deformed homogenously in their entire length and for engineering strains up to 200% showing only minute fluctuations in their post-stretching diameter, as shown in FIG. 19(*c*). On the other hand, nanofibers obtained for fabrication conditions #3 and #6 in FIG. 19(*b*), did not stretch in a uniform manner. Instead, their extension was accompanied by the formation of multiple surface ripples as shown in FIG. 19(*d*). The nanofibers in fabrication conditions #3 and #6 experienced the highest average electric fields, namely 1.67 kV/cm and 1.33 kV/cm, respectively, and were fabricated at the shortest spinning distance of 15 cm in both cases. Thus, high electric fields (>1 kV/cm) resulting in high PAN jet acceleration towards the target 115 and short jet travel distances were conducive to the formation of periodic ripples in nanofiber surfaces under subsequent cold drawing. The PAN nanofibers thus formed are excellent precursors for advanced, carbon nanofibers with modulated surfaces. This surface rippling is distinguished from the usual necking in cold drawn macroscale polymeric fibers. In macroscale fibers, typically a single neck initiates in the sample, which induces stress localization and, depending on the drawing rate, the neck stabilizes in diameter and propagates along the fiber with final failure. In contrast, in the present PAN nanofibers, multiple ripples formed at the same time during cold drawing, FIG. 3(*a*) and FIG. 19(*b*), and did not propagate. Secondly, the ratio of final neck diameter to undeformed fiber diameter is relatively constant (i.e., there is geometric proportionality due to volume conservation) for microscale fibers fabricated under identical conditions. In contrast, the ripple amplitude and wavelength was almost the same for PAN nanofibers with different diameters from ~300 nm to ~600 nm, as shown in FIGS. 3(*b*) and 3(*c*). This suggests that a surface process causes the formation of periodic ripples. This surface rippling can be also accomplished by using coaxial electrospinning to produce composite coaxial nanofibers with a relatively brittle shell and a ductile core. Such coaxial nanofibers may be produced in a coaxial electrospinning process using two dissimilar materials (e.g., two different polymers) or two different formulations of the same polymer (e.g., where each formulation has a different density). By varying the thickness of the shell, it is possible to control the waviness amplitude and wavelength. Thus, it is important in forming nanofibers with modulated surfaces to provide a core-shell structure with the core being ductile and the shell being relatively much more brittle.

The periodic rippling shown above is independent of the fiber diameter. To identify the origins of the periodic rippling in FIGS. 19(*d*) and 3(*a*), several nanofibers were drawn to strains between 20-200% strain at strain rate of $2.5\cdot10^{-3}$ $s^{-1}$. The tests began with initially smooth nanofibers, FIG. 20(*a*), that were loaded to a given strain level, then unloaded and removed from the loading apparatus without further changes in their loading history. Finally they were imaged with an SEM. Starting at about 20% the first surface cracking was observed and became widespread at about 60% strain as shown in FIG. 20(*b*). The nanofibers were subjected to surface shell cracking similarly to fragmentation occurring when in-plane loading is applied to the system of a brittle coating on a ductile substrate. Thus, in an analogy it is concluded that the nanofiber core is more ductile compared to the skin. The relative brittleness of the fiber skin compared to fiber core is due to increased solvent evaporation in the fiber skin that sealed the core from complete loss of solvent after electrospinning is completed. The solvent acts as plasticizer and facilitates the deformability of the fiber core. The similarities between the shape of the cracks shown in FIGS. 20(*b*)-20(*d*) suggest that the fragmentation sites in FIG. 20(*b*) triggered the formation of the surface ripples observed in FIGS. 20(*c*) and 20(*d*) by inducing stress concentrations at the fiber surface at the location of each surface crack.

Figure 21A:
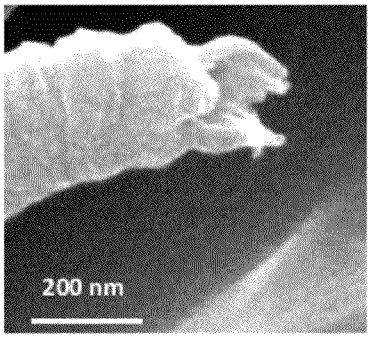
FIGS. 21(*a*)-21(*c*) show SEM images of the fractured PAN nanofibers showing the core-shell structure, including: (a,b) the fractured surface of the skin exposed the inner side of the skin on the further side of the nanofiber, and (c) stripped fiber core (left end of nanofiber) pulled out of the skin on the other side of the fiber.
Figure 21B:
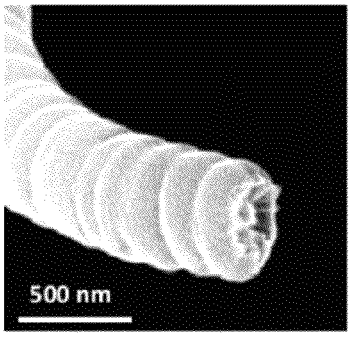
Figure 21C:
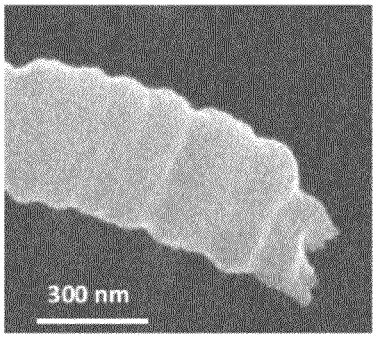

SEM images of nanofiber failure cross-sections pointed to a core-skin structure in electrospun PAN nanofiber manufactured under conditions #3 and #6 in FIG. 19(*a*). FIG. 21(*a*) shows the skin of a nanofiber at its broken end. The unevenly fractured surface of the skin allows a view of the inner side of the skin on the farther side of the nanofiber. Similar conclusions are derived from FIG. 21(*b*). On the other hand, FIG. 21(*c*) shows the stripped nanofiber core, which has pulled out of the skin on the other side of the nanofiber.

The formation of pronounced periodic surface ripples in polymer nanofibers is highly strain rate sensitive. At strain rates $\geq 2.5\cdot10^{-3}$ $s^{-1}$, ripples formed on the fiber surface with a spatial frequency of about 150 nm. On the other hand, at lower strain rates, e.g., $2.5\cdot10^{-4}$ $s^{-1}$, surface ripple formation is diminished and only shallow and fine surface ridges form on the fibers. At slow strain rates, stress the concentrations at surface cracks are alleviated by the stress relaxation which is substantial at slow strain rates, and because of that, surface cracks are arrested, FIG. 22(*a*). Therefore, nanofibers drawn at $2.5\cdot10^{-4}$ $s^{-1}$ deformed uniformly with small fluctuations in their diameter, FIG. 22(*c*).

Figures 22A, 22B, 22C:
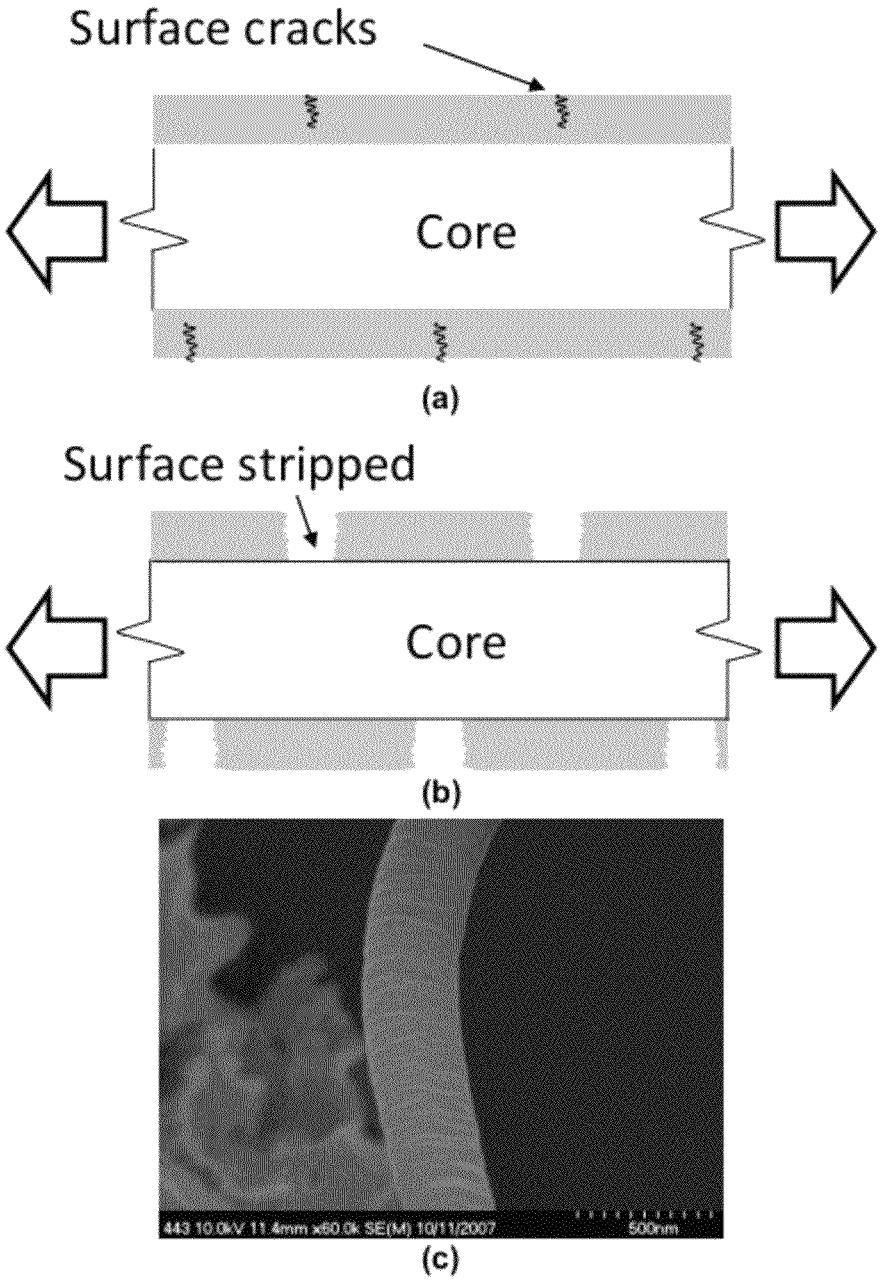
FIG. 22(*a*)-22(*c*) show surface rippling of PAN nanofibers at slow strain rates: (a) Fragmentation of surface skin at strains >20% resulting in periodic surface cracks that act as stress concentrations, (b) at sufficiently low strain rates, relaxations occurring in the nanofiber core at the sites of stress concentrations and reduce the stress at the crack tips not allowing the propagation of the cracks to the core but the instead the formation of periodic surface ripples as in FIGS. 19(*d*) and 3(*a*), and (*c*) SEM image of a PAN nanofiber loaded at the slow strain rate of $2.5 \cdot 10^{-4}$ $s^{-1}$ where fine surface ripples are seen but no periodic ripples similar to those in FIG. 20(*d*)
Figures 23A, 23B, 23C:
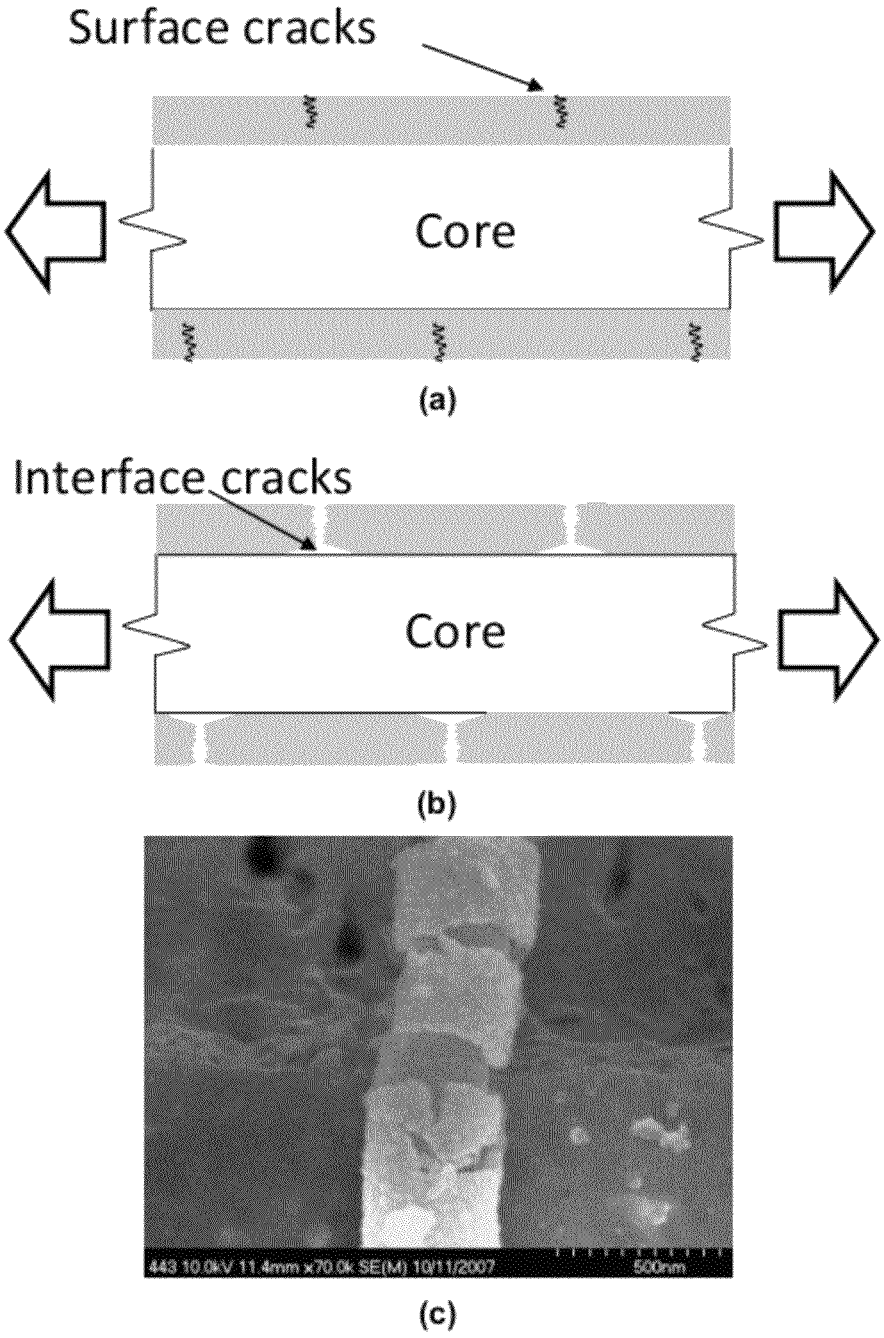
FIGS. 23(*a*)-23(*c*) show the development of surface rippling at high strain rates: (a) Fragmentation of surface skin at strains >20% resulting in periodic surface microcracks that act as stress raisers, (b) at high strain rates, stress relaxation does not take place to alleviate the stress at the crack tips, thus resulting in lateral cracks and skin debonding, and (c) SEM image of a PAN nanofiber after subjected to loading at ~100 $s^{-1}$, showing complete debonding of the nanofiber skin.

On the other hand, at strain rates $10^{-2}$ $s^{-1}$ or faster, upon skin crack initiation, the stress concentration at the location of the cracks is not relaxed, which allows for further crack propagation, and strain localization in the form of ripples, FIG. 22(*b*). In addition, in the absence of substantial relaxation, the skin cracks may grow laterally due to mechanical properties mismatch between the skin and the core, and the high interfacial shear stress that is developed between the fragmented skin and the stretched fiber core, FIG. 23(*b*). At very high loading rates, this shear stress may not be promptly reduced by macromolecular relaxations, and cracks may propagate laterally to debond the nanofiber skin from its core. An SEM image of the cracked skin with stripped core is shown in FIG. 23(*c*). This nanofiber was stretched at a high strain rate of ~100 $s^{-1}$.

Therefore, there are optimal strain rates during cold drawing to achieve the periodic surface rippling of PAN nanofibers, in particular from about $2.5\cdot10^{-2}$ $s^{-1}$ to about 100 $s^{-1}$. At slower strain rates (less than $2.5\cdot10^{-2}$ $s^{-1}$), uniform cross-sections are produced, and at faster strain rates (greater than 100 $s^{-1}$), total delamination of the surface shell may occur. Thus, controlling the strain rate during cold drawing provides a method to control the surface morphology of nanofibers.

A consequence of high stretching ratios of the polymer solution jet during electrospinning is the increased free surface of the solution, which results in higher rates of solvent evaporation. The governing equations for solvent evaporation of polymer solution jets with diameters of the order of a micron or less, suggest a core-shell structure (e.g., see Dayal P. and Kyu T., 2006, *Journal of Applied Physics,* 100, 043512 and Guenthner A. J., et al, 2006, *Macromolecular Theory and Simulation,* 15, 87-93). These studies predict the formation of a layer on the jet surface, which is dense in polymer, which as the solvent evaporates, is expanded towards the core to reduce the solvent content. According to Dayal and Kyu, this process is controlled by the rate of solvent evaporation: Fast solvent evaporation results in a surface layer relatively rich in polymer content with gradual increase of solvent content toward the fiber center, see FIG. 24(*b*). At slower evaporation, the dense skin is relatively richer in solvent compared to the previous case and a gradual decrease of the polymer content from the surface to the core is predicted. Therefore, the material is more homogenized, as shown in FIG. 24(*a*). At lower temperatures and evaporation rates, the evaporation of the solvent may result in the formation of a continuous skin, distinctly high in its polymer content from the core, while the core of the fiber acquires a "porous" structure containing both solvent and polymer macromolecules. If the evaporation rate is further suppressed, porous nanofibers with no discernable skin may form, see FIG. 24(*c*).

Based on the similarities between the SEM images of fractured nanofibers in FIG. 21 and the numerical predictions in in the Dayal reference mentioned above, the inventors conclude that high electric fields (>1.33 kV, fabrication conditions #3 and #6 in FIGS. 19(*a*) and 19(*b*) resulted in formation of radially nonuniform nanofibers with a dense skin, FIG. 19(*d*). On the other hand, nanofibers fabricated at lower electric fields deformed homogeneously with no sign of surface rippling, FIG. 19(*c*). Electrostatic forces on a polymeric solution scale with the electric field intensity during electrospinning. Consequently, at higher electric fields, the polymer jet accelerates faster and gains higher velocity, which increases convection and, therefore, solvent evaporation. The early loss of solvent on the surface increases the viscosity of surface molecules and therefore the applied shear forces that cause increased density in the surface and molecular alignment. This explains the hard shell—compliant core nanofiber structure which is needed for the fabrication of nanofibers with modulated surfaces.

In summary, a method for producing one or more nanofibers with uniform densities or with core-shell structure has been described. The method includes providing (a) a solution comprising a polymer and a solvent, (b) a nozzle for ejecting the solution, and (c) a stationary collector disposed a distance d apart from the nozzle. A voltage is applied between the nozzle and the stationary collector, and a jet of the solution is ejected from the nozzle toward the stationary collector. An electric field intensity of between about 0.5 and about 2.0 kV/cm is maintained, where the electric field intensity is defined as a ratio of the voltage to the distance d. The distance d between the nozzle and the collector defines the amount of solvent and final molecular orientation in the nanofibers. Typically a substantial portion of the solvent from the jet is evaporated during travel to the collector. One or more polymer nanofibers are deposited on the stationary collector as the jet impinges thereupon.

Low electric field intensities (e.g., about 1.2 kV/cm or lower) have been shown to result in nanofibers with uniform cross-sections, and higher electric field intensities (e.g., about 1.3 kV/cm and higher) have been shown to result in nanofibers with core-shell structure. Upon stretching of the latter at a suitable strain rate, polymer nanofibers with periodically rippled surfaces can be manufactured. Each polymer nanofiber has an average diameter of about 500 nm or less (more typically 150-250 nm) and may serve as a precursor for carbon fiber production. An optimal carbonization temperature range of 1100° C. to 1700° C. provides carbon nanofibers with maximum possible fiber strength exceeding 2 GPa.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

The invention claimed is:

1. A method of producing one or more nanofibers, the method comprising:

providing (a) a solution comprising a polymer and a solvent, (b) a nozzle for ejecting the solution, and (c) a stationary collector disposed a distance d apart from the nozzle;

applying a voltage between the nozzle and the stationary collector;

ejecting a jet of the solution from the nozzle toward the stationary collector;

maintaining an electric field intensity between about 0.5 and about 2.0 kV/cm as the jet is ejected, the electric field intensity being defined as a ratio of the voltage to the distance d;

evaporating at least a portion of the solvent from the jet;

depositing one or more polymer nanofibers on the stationary collector as the jet impinges thereupon, each polymer nanofiber having an average diameter of about 500 nm or less;

after the depositing, cold drawing the one or more polymer nanofibers at a strain rate between about $10^{-4}$ $s^{-1}$ and 200 $s^{-1}$; and after the cold drawing, forming carbon nanofibers from the one or more polymer nanofibers.

2. The method of claim 1, wherein the distance d is at least about 25 cm.

3. The method of claim 1, wherein the distance d is about 20 cm or less.

4. The method of claim 1, wherein the electric field intensity is between about 1.3 kV/cm and about 1.7 kV/cm.

5. The method of claim 1, wherein the electric field intensity is between about 0.8 kV/cm and about 1.2 kV/cm.

6. The method of claim 1, wherein the cold drawing is carried out at a strain rate between about $2.5\times10^{-2}$ $s^{-1}$ and about 100 $s^{-1}$.

7. The method of claim 1, wherein forming the carbon nanofibers comprises:

stabilizing the one or more polymer nanofibers by heating at a temperature of at least about 300° C. for 1 hour, thereby forming one or more stabilized nanofibers; and carbonizing the one or more stabilized nanofibers to form the carbon nanofibers, the carbonizing comprising heating the stabilized nanofibers at a temperature between about 1400° C. and about 1700° C.

8. The method of claim 1, wherein the stationary collector comprises a plurality of parallel metal wires.

9. The method of claim 1, wherein the stationary collector is grounded.

* * * * *